US007140853B2

(12) United States Patent
Al Hawaj

(10) Patent No.: US 7,140,853 B2
(45) Date of Patent: Nov. 28, 2006

(54) AXIAL VANE ROTARY DEVICE

(76) Inventor: Osama M Al Hawaj, P.O. Box 15462, Daiyah (KW) 35455

( * ) Notice: Subject to any disclaimer, the term of this patent is extended or adjusted under 35 U.S.C. 154(b) by 136 days.

(21) Appl. No.: 10/935,680

(22) Filed: Sep. 7, 2004

(65) Prior Publication Data

US 2006/0048743 A1 Mar. 9, 2006

(51) Int. Cl.
*F01C 1/344* (2006.01)
*F02B 53/00* (2006.01)

(52) U.S. Cl. ..... 418/219; 123/241; 123/243

(58) Field of Classification Search ..... 123/241, 123/243; 418/219
See application file for complete search history.

(56) References Cited

U.S. PATENT DOCUMENTS

| | | | | | |
|---|---|---|---|---|---|
| 299,260 | A | * | 5/1884 | Price | 418/219 |
| 997,204 | A | * | 7/1911 | Morehouse | 418/219 |
| 1,683,962 | A | * | 9/1928 | Crown | 418/219 |
| 1,743,977 | A | * | 1/1930 | Petersen | 418/219 |
| 2,020,611 | A | * | 11/1935 | Knapp | 418/219 |
| 2,593,457 | A | * | 4/1952 | Jastrzebski | 418/219 |
| 3,769,945 | A | * | 11/1973 | Kahre | 418/219 |
| 3,838,954 | A | * | 10/1974 | Rapone | 418/219 |
| 4,028,028 | A | * | 6/1977 | Fuchs, Jr. | 418/219 |
| 4,439,117 | A | * | 3/1984 | Bunger | 418/219 |
| 5,429,084 | A | | 7/1995 | Cherry et al. | 123/243 |
| 6,135,745 | A | * | 10/2000 | Blasingame | 418/219 |

FOREIGN PATENT DOCUMENTS

| | | | |
|---|---|---|---|
| EP | 0 063 529 | A1 * | 10/1982 |
| JP | 60230501 | A * | 11/1985 |

* cited by examiner

*Primary Examiner*—Thai-Ba Trieu
(74) *Attorney, Agent, or Firm*—David Kiewit

(57) ABSTRACT

An axial vane rotary power device comprises a rotor arranged to turn within an annular chamber having two end plates with mutually facing undulating cam surfaces. Vanes retained in angularly spaced slots in the rotor reciprocate axially as the rotor turns. Transfer passages, interleaved between the vanes, connect each working chamber to a respective transfer port at the central bore of the rotor. A tubular inner stator member, about which the rotor turns, has two sets of peripheral ports that provide fluid communication between the working chambers and intake and exhaust channels as the rotor turns. Various configurations of the device allow it to function as either a two- or four-phase internal combustion engine, a fluid driven motor, a pump, a compressor or an expander.

23 Claims, 25 Drawing Sheets

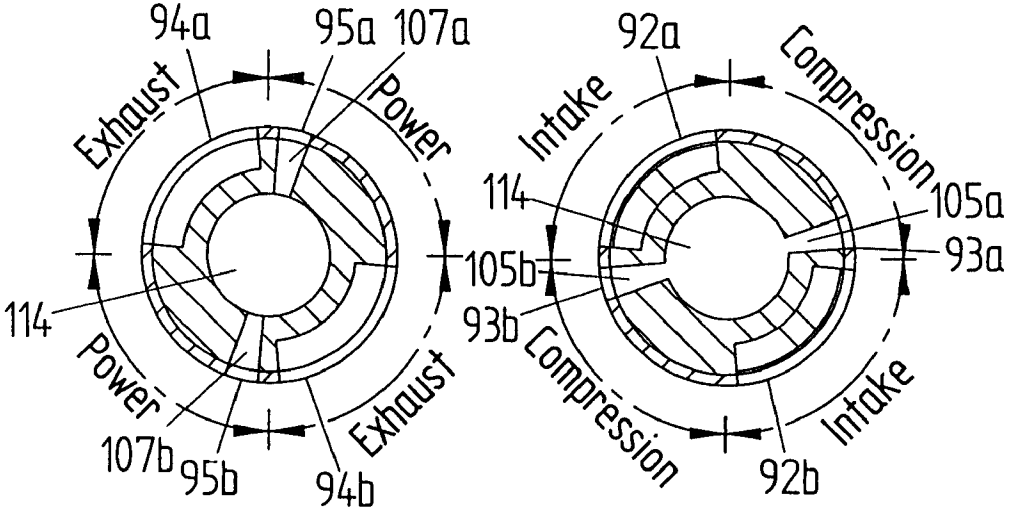
FIG. 29a
FIG. 29b
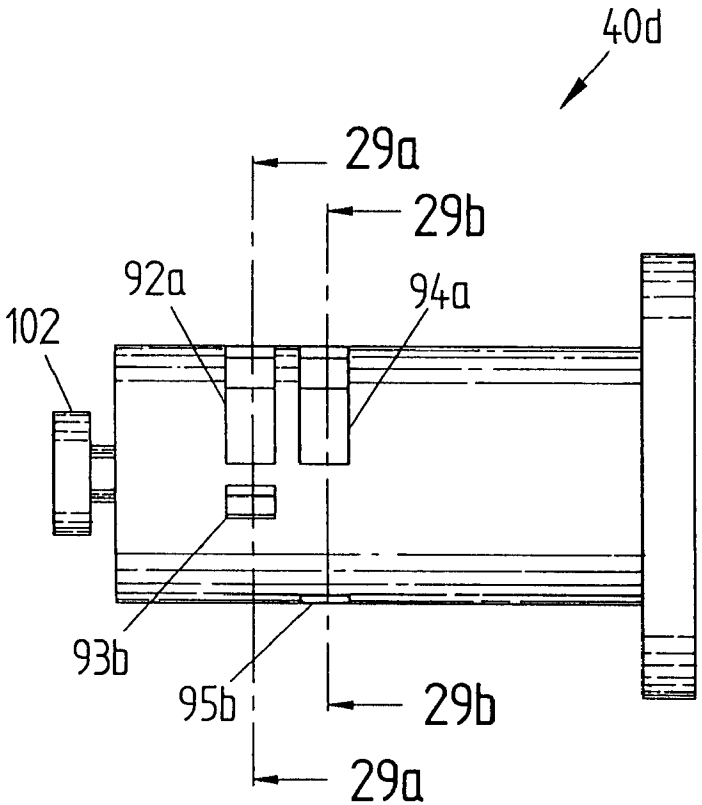
FIG. 28

AXIAL VANE ROTARY DEVICE

BACKGROUND OF THE INVENTION

1. Field of the Invention

The invention relates to rotary devices of the axial vane type, in which a volume change occurs between adjacent vanes and cam surfaces on each side of the rotor and in which the vanes translate axially with respect to the rotational axis of the rotor. More particularly, the present invention relates to an internally supercharged and turbocharged axial vane rotary device and a method for vane actuation in axial vane rotary devices.

2. Description of Related Art

A typical prior art axial vane rotary device (e.g. U.S. Pat. No. 5,429,084 to Cherry et al.) comprises an external stator enclosing a cylindrical chamber having an annular outer wall and end walls. Each end wall has an axially undulating cam surface parallel with respect to the other end so that high portions of the cam surface of one end align with low portions of the cam surfaces at the opposite end. A rotor is rotatably mounted within the chamber. The rotor has an annular outer wall and a plurality of angularly spaced apart, axially extending slots extending therethrough. A vane is slidably received in each slot. The vanes reciprocate axially and alternately expand and contract volumes between adjacent vanes and the axially undulating end walls as the rotor rotates. Each axially undulating end wall has alternating first and second portions. The second portions are further away from the rotor than the first portions. The first portion of one end wall is aligned with a second portion of the opposite end wall so that the axial distance between them remains constant. The slots extend radially outwards on the rotor to the outer wall thereof. The outer end of each vane slidably engages the annular outer wall of the stator. The outer wall of the stator may have a guide cam and vanes may have a follower received by the guide cam. The guided cam is shaped to cause the vanes to reciprocate axially with respect to the rotor as the rotor rotates. Each vane may have resiliently biased first seals extending along the inner edge and second seals along end edges thereof.

In the above prior art, as the rotor rotates, the vanes move outward due to centrifugal force and make sliding contacts on the annular outer wall, which may be lubricated by an oil film, and the side edges of the vanes make sliding contact with the axially undulating cam surfaces, thus causing the vane to reciprocate as the rotor rotates. This arrangement is adequate in a small axial vane rotary device or in one operating at low speed with provision for appropriate lubrication at the outer and side edges of the vanes. In axial rotary devices that are large or that operate at high speed, excessive centrifugal forces and shear forces cause large outer and edge tip loading of the vanes and result in excessive wear and damage to wall surfaces and vanes. In effort to overcome these problems, the reciprocating motion of the vane is actuated by a pin projecting from the vane, equipped with an anti-friction shoe, as the follower that is received by the guide cam. Although this arrangement alleviates the outer and side tip loading by conveying such loading to the pin, the pin itself often can not withstand such large friction forces without breaking.

In the above prior art, the intake and exhaust ports comprise passages through the undulating end walls. This arrangement makes the fabrication of such surfaces more complex.

In the above prior art, the design of the engine does not permit inclusion of internal supercharging or turbo-charging capability and thereby any such charging has to be performed externally. The advantage of internal super- and turbo-charging is the efficient utilization of space and a reduction of pressure losses associated with conduit interconnection, as well the reduction of the complexity associated with such inter-connection.

SUMMARY OF THE INVENTION

An overall object of the invention is to provide an improved axial vane rotary power device which overcomes the disadvantages associated with earlier engines of the type.

One objective of the present invention is to provide a simple and improved vane actuation mechanism that reduces outer and side tip loading of vanes in a rotary vane engine.

Another objective of the present invention is to provide an internal supercharging and turbo charging capability in a rotary vane engine.

Still another objective of the present invention is to provide an improved intake and exhaust porting structure allowing for simpler and lower cost cam surface construction.

In accordance with the objectives, a preferred embodiment of the invention provides an axial vane rotary device of the type including a stator and a rotor. The stator comprises an outer external stator portion and internal stator portion. The external stator portion comprises a middle portion and two end portions. The middle portion preferably comprises axially split mating half portions, arranged so that each half portion has an axially undulating cam guide having a predominantly circular cross-section. The end portions comprise axially undulating walls that follow the profile of the guide cam. The internal stator portion comprises a cylindrical tubular element coaxially extending from and fixedly attached to one end wall portion. The internal stator portion comprises at least one pair of axially spaced apart peripheral intake and exhaust ports. A preferred internal stator encompasses a turbocharger assembly comprising a shaft with a compressor impeller coupled to one end, a turbine runner coupled to the other end, and a middle bearing. The turbocharger assembly is rotatably carried within a tubular internal stator. A rotor is rotatably mounted within the chamber defined by the inner annular wall of the external stator, the outer annular wall of the internal stator and the axially undulating end walls. The rotor has an annular outer wall and a plurality of angularly spaced-apart, axial slots extending therethrough. The rotor has a central bore adapted to rotatably receive the internal stator with a small clearance between respective annular surfaces. The rotor comprises a paired plurality of equally angularly spaced apart passages. Pairs of these passages are preferably mirror-images with respect to a middle transverse plane of the rotor. Each passage is preferably confined between two adjacent slots that include a side opening and an inner opening through the bore that is axially aligned with a pair of intake and exhaust ports of the internal stator. A plurality of vane assemblies is slidably disposed in slots. Each vane has side edges slidably engaging the undulating end walls and outer edges slidably engaging the outer annular wall. The rotor block is coupled to an end shaft through a set of blades extending from the shaft to the hub portion of the rotor. The effect of the fan blades is to act as a supercharger by increasing the mass flow of air passing from the front end stator portion into the interior.

One aspect of the invention is a vane actuation mechanism comprising an axially undulating guide cam in the external stator, preferably comprising a groove having predominantly semi-circular cross section. The cam follower comprises a ball element, preferably of self-lubricating material, retained within a hemi-spherical recess in the vane outer tip portion and engaging the guide cam.

Another aspect of a preferred embodiment of the invention is that it provides an axial vane rotary device having high power to weight ratio.

An aspect of a preferred embodiment of the invention is that it provides an axial vane rotary device with integral supercharging capability.

Another aspect of a preferred embodiment of the invention is that it provides an axial vane power device with internal turbo-charging capability.

Yet another aspect of a preferred embodiment of the invention is that it provides an axial vane rotary device that can be configured to operate as either a two or a four cycle internal combustion engine by modification of the cam and of the internal stator's porting arrangement.

Still another aspect of a preferred embodiment of the invention is that it provides an axial vane rotary device that can be configured to operate as pump, a compressor, or an expander by employing an internal stator having appropriate porting arrangements.

BRIEF DESCRIPTION OF THE DRAWINGS

FIG. 28 is a side elevation view of the inner stator portion of FIG. 26.

FIG. 29*a* is a cross-sectional view taken along line 29*a*—29*a* of FIG. 28.

FIG. 29*b* is a cross-sectional view taken along line 28*b*—28*b* of FIG. 28.

Figure 30:
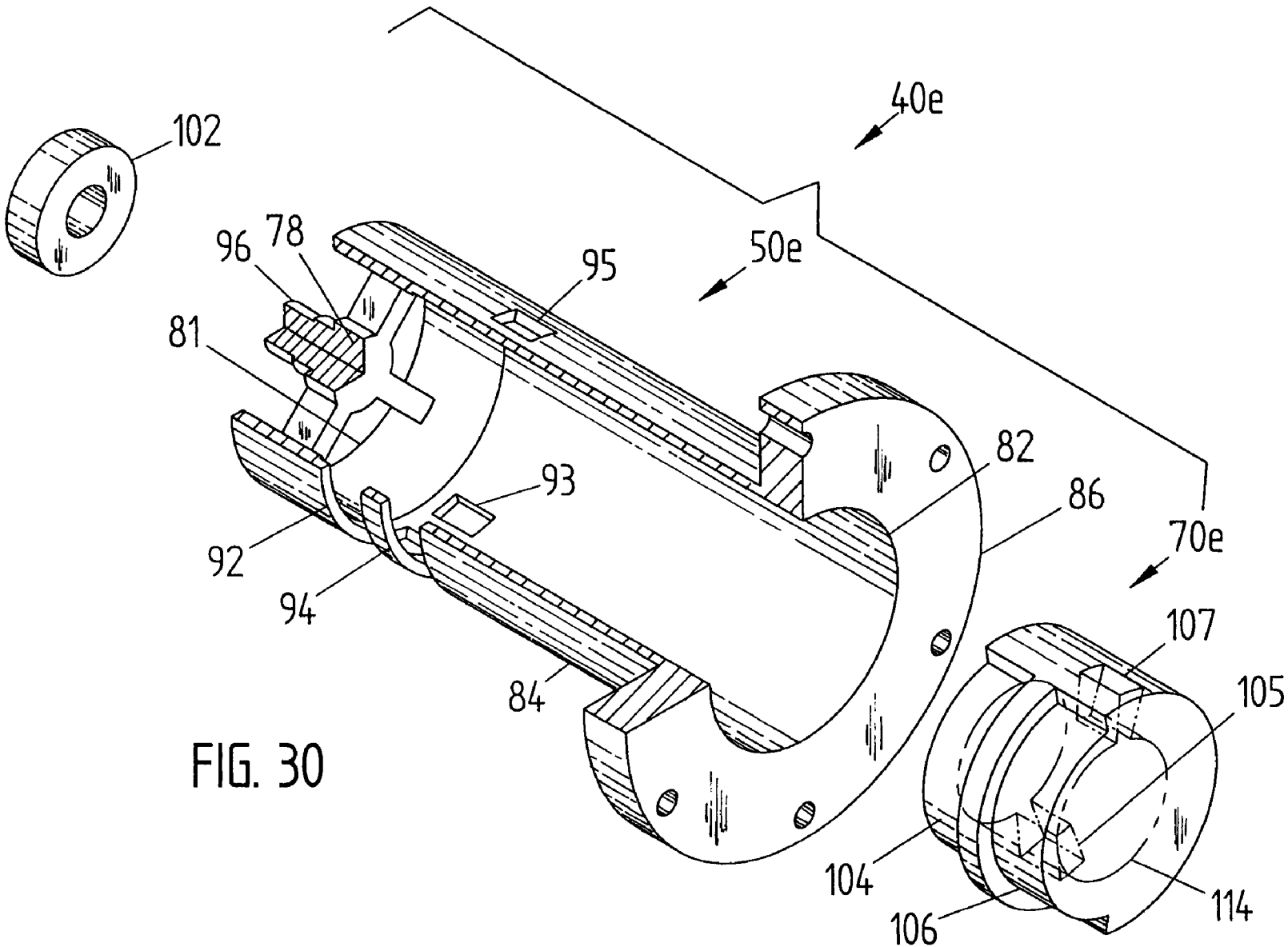
FIG. 30 is an exploded isometric view of the inner stator portion of an alternative axial vane rotary device of the invention having the cam surface profile depicted in FIG. 17 and configured to operate as an internal combustion engine in which intake and compression phases occur on one side of the rotor and power and exhaust phases on the other.
Figure 31:
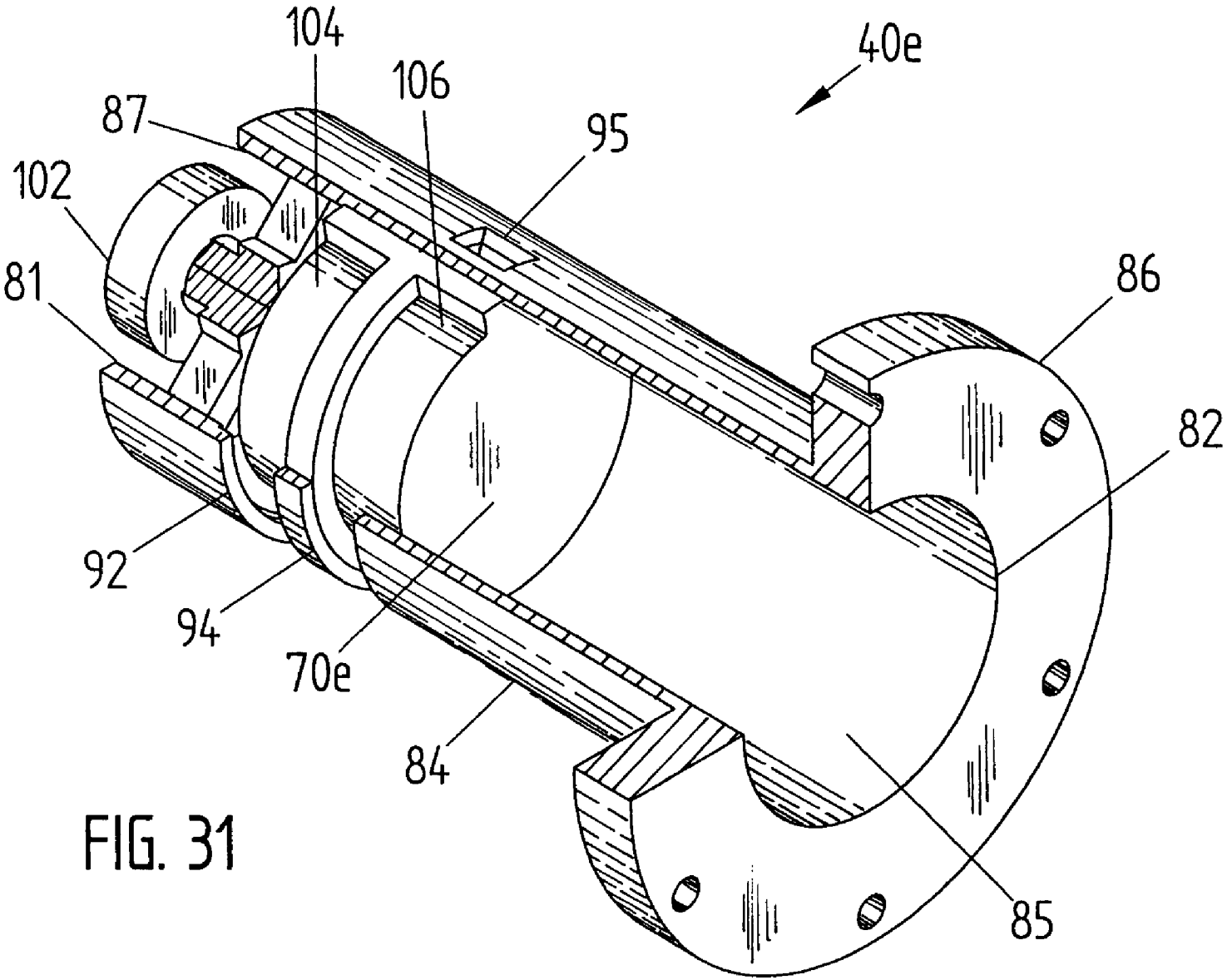

FIG. 31 is an isometric view of the inner stator portion of FIG. 30 having a portion cut away for the purpose of illustration.

Figure 32:
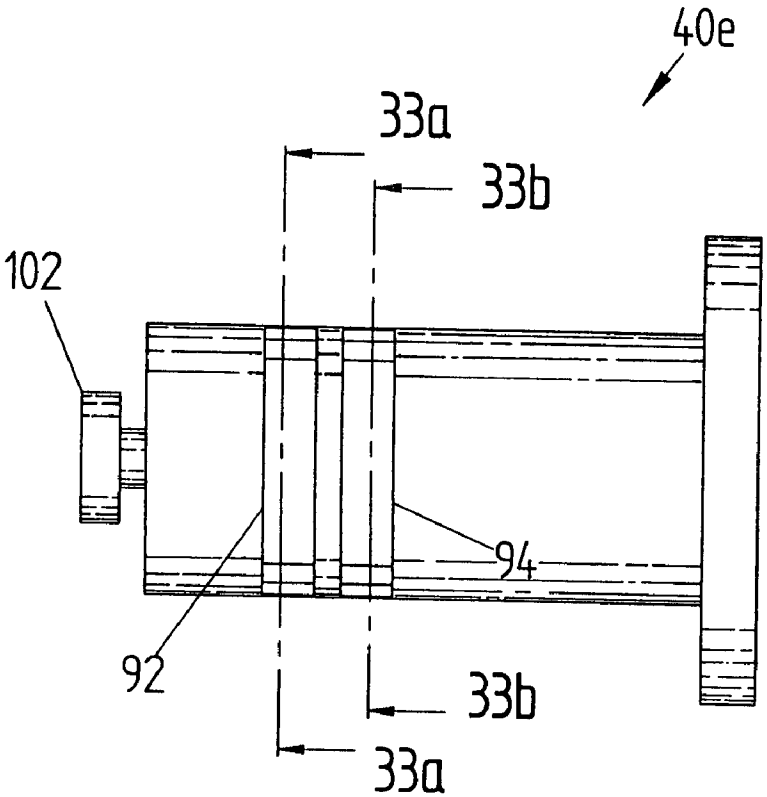

FIG. 32 is a side elevation view of the inner stator portion of FIG. 30.

Figure 33A:
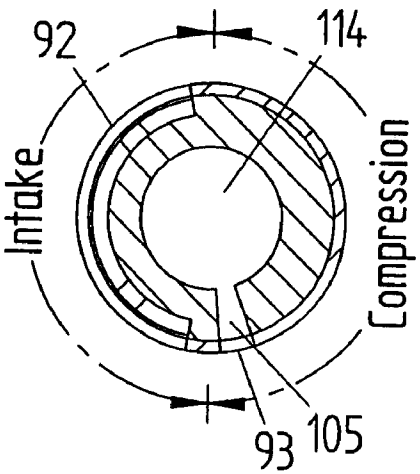

FIG. 33*a* is a cross-sectional view taken along line 33*a*—33*a* of FIG. 30.

Figure 33B:
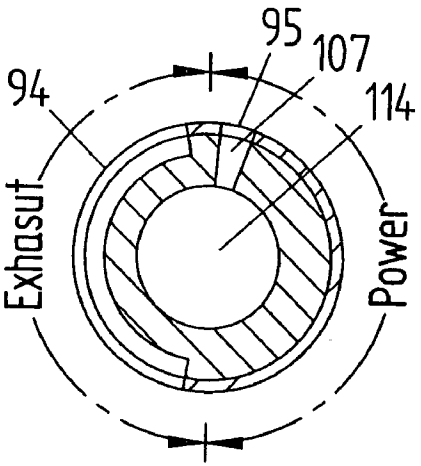

FIG. 33*b* is a cross-sectional view taken along line 33*b*—33*b* of FIG. 30.

DESCRIPTION OF THE PREFERRED EMBODIMENTS

In studying this Detailed Description, the reader may be aided by noting definitions of certain words and phrases used throughout. Wherever those definitions are provided, those of ordinary skill in the art should understand that in many, if not most instances, such definitions apply to prior, as well as future uses of such defined words and phrases. At the outset of this Description, one may note that the terms "include" and "comprise," as well as derivatives thereof, mean inclusion without limitation; the term "or," is inclusive, meaning and/or; the word "discharge" which is commonly used to denote fluid flow out of a pump or the like and the word "exhaust" which is commonly used to denote fluid flow out of an internal combustion engine are used synonymously; and the terms "two-phase" and "four-phase" are used to describe operation of various embodiments of the invention that are respectively analogous to the two-cycle and four-cycle modes of operation of a conventional piston engine.

Figure 1:
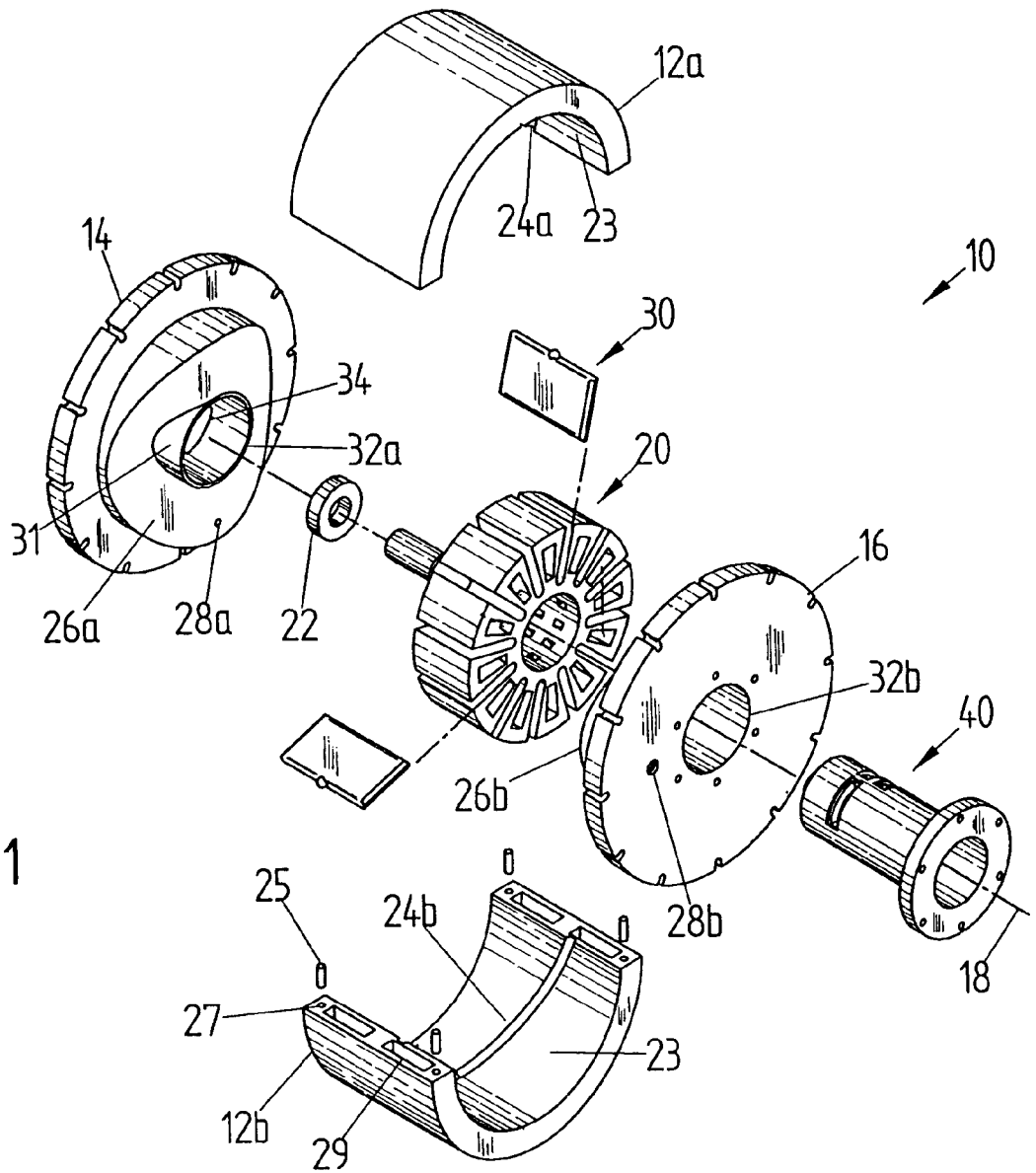
FIG. 1 is an exploded isometric of an axial vane rotary device of the invention.
Figure 2:
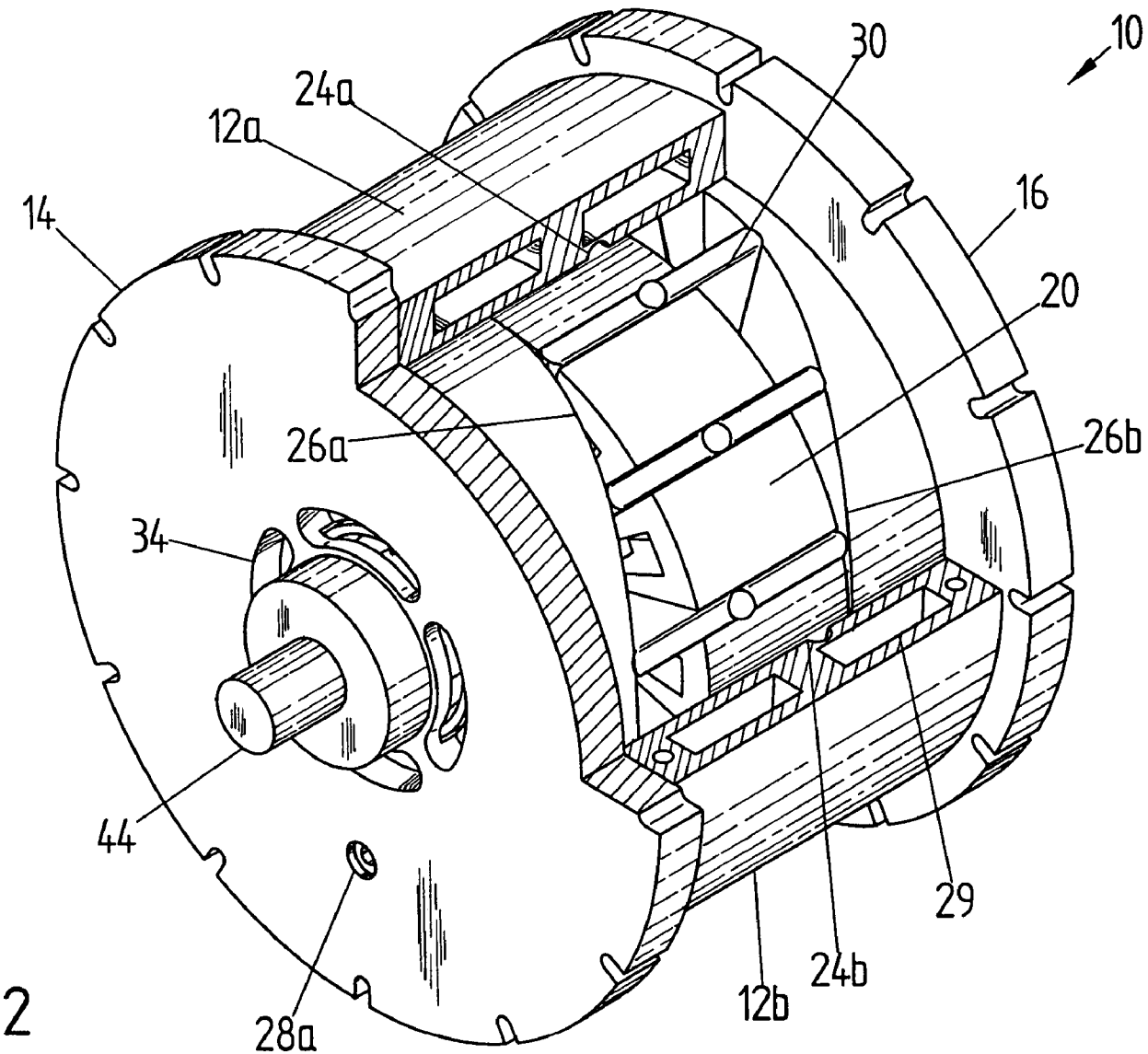
FIG. 2 is an isometric view of the rotor of the axial vane rotary device of FIG. 1 in which a portion of the front end plate and upper half casing are cut away for the purpose of illustration.
Figure 3:
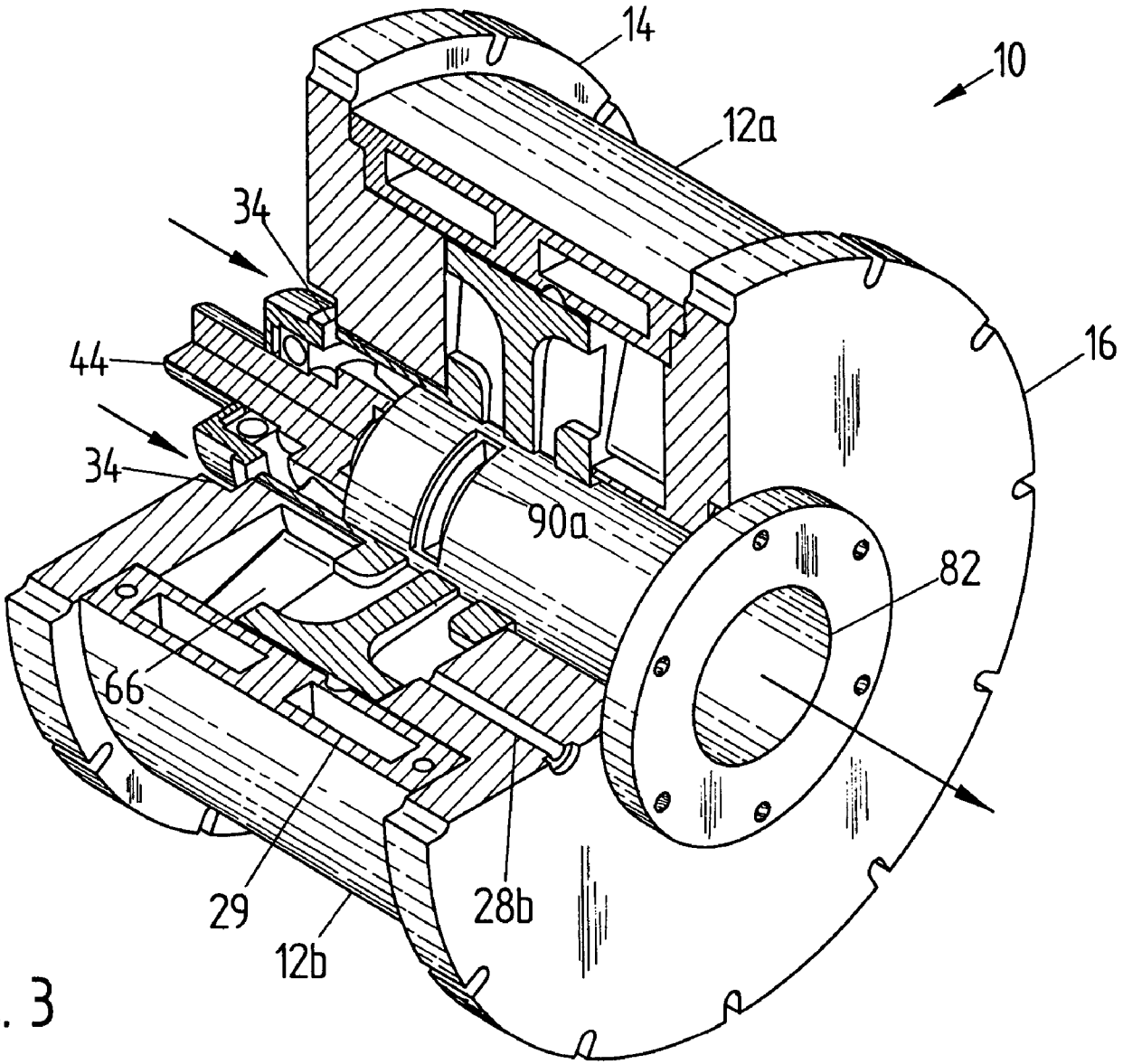
FIG. 3 is an isometric view of the rotor of the axial vane rotary device of FIG. 1 in which a quarter of the casing and rotor assembly are cut away for the purpose of illustration.

FIGS. 1 through 3 show an axial vane rotary device configured as a four-phase internal combustion engine. Referring to FIG. 1, the engine 10 comprises an external stator portion comprising a front end plate 14 and a back end plate 16 joined together by a middle portion comprising axially split cylindrical mating halves depicted as an upper half 12*a* and a bottom half 12*b*. The two halves are aligned together along an axial splitting plane, preferably by alignment pins 25 and holes 27. The end plates and middle portions may be coupled together by conventional tie rods or fixture means (not shown). The external stator portion may comprise cooling passages 29 in the middle portion of the external stator as well as within the end plates (not shown).

The inner annular wall of the preferred upper stator portion 12*a* comprises a groove 24*a* or guide cam and the lower stator portion comprises a similar mirror-image cam groove 24*b*. The two grooves mate at the axial splitting plane to form a continuous cam groove. The depicted front end plate 14 comprises an annular undulating cam surface 26*a* surrounding a central tubular portion 32*a* comprising intake openings 34 and a central opening for the protruding rotor shaft 44. Correspondingly, the depicted back end plate 16 comprises a similar annular undulating cam surface 26*b* surrounding a respective tubular portion 32*b* configured to receive the internal stator assembly 40. The mutually facing end plate cam surfaces comprise two opposite first portions relatively distant from a respective end plate and alternated by another two diagonally opposite second portions relatively proximal to the respective end plates. The first portion of one end plate is preferably axially aligned with the second portion of the opposite end plate so that the axial gap distance between cam surfaces remains fixed during the traverse of a complete circle around the axis of rotation 18.

For the engine shown in FIG. 1, the front end plate 14 comprises an ignition port 28*a* and the back end plate 16 comprises an ignition port 28*b*, each disposed within one of the first portions of a respective cam surface and each forming a ninety degree angular shift relationship with respect to the other. Each ignition port is arranged to receive an ignition means such as a spark plug, a glow plug or an injector (not shown).

A preferred internal stator assembly 40 is disposed within the tubular portion 32*b* of the end plate 16 and is fixed to that end plate by fixture means (not shown) so that it axially protrudes through the chamber and thereby defines, with the external stator portion, a predominantly annular chamber. The internal stator assembly 40 comprises intake and exhaust ports and may include a turbocharger assembly.

Figure 4:
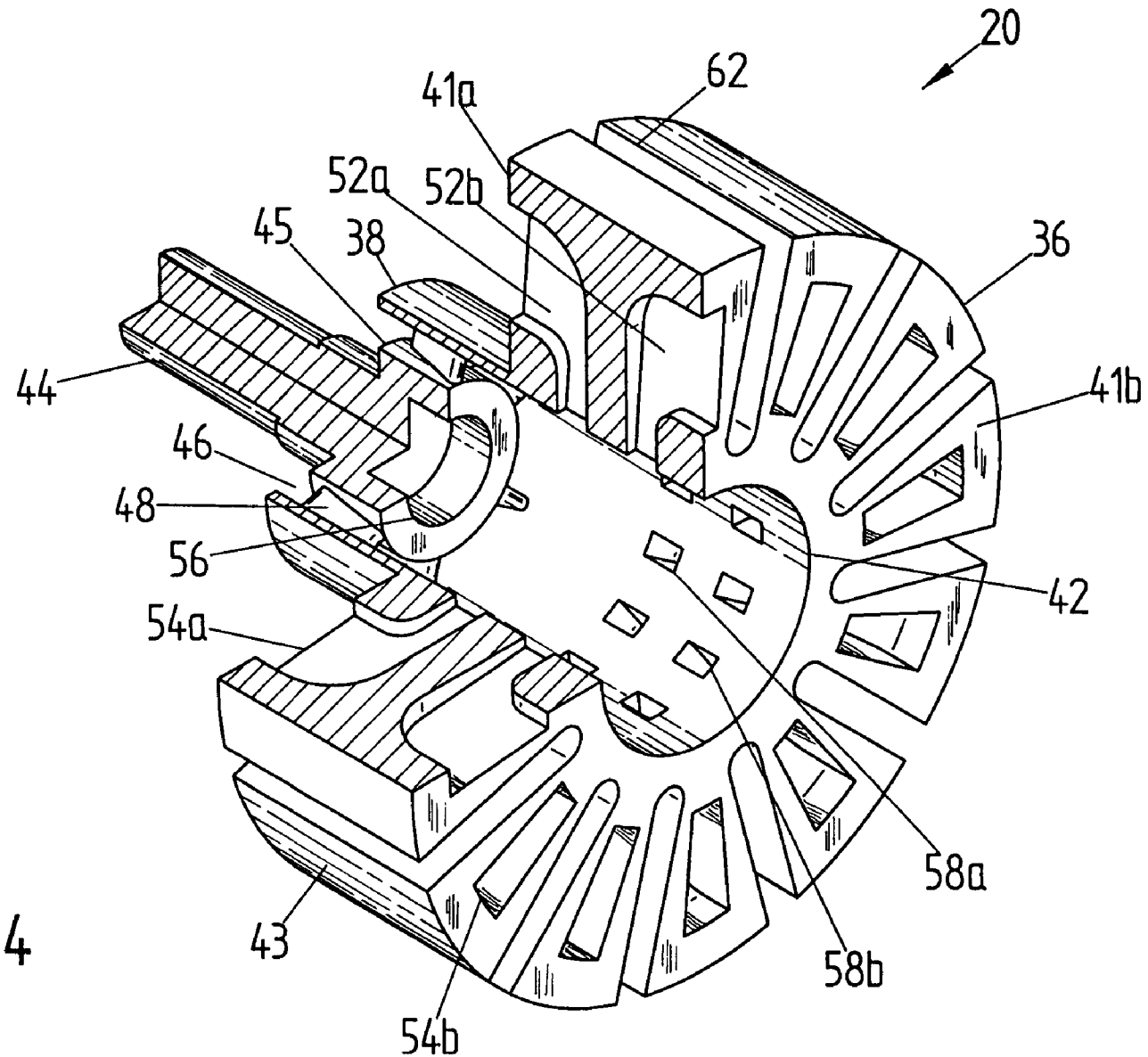
FIG. 4 is a partly cut away isometric view of the rotor of the axial vane rotary device of FIG. 1.

A rotor assembly 20, comprising the rotor blade assembly 30 is rotatably mounted coaxially along an axis of rotation 18 and within the annular chamber space defined by the outer annular wall of the external stator portion and the inner annular of internal stator portion. The rotor 20, as shown in FIG. 4, preferably comprises a cylindrical block portion 36 coupled to an end shaft 44 by a set of radially extending blades 48, each having a respective innermost portion fixed to the shaft hub portion 45 and a respective outermost portion fixed to the inner annular wall of the tubular hub portion 38 that is fixed to the side 41*a* of the rotor block. The end shaft 44 is journaled within a shaft bearing 22 carried by the end plate 14. The cylindrical block 36 comprises a central bore 42 extending from the rotor side 41*b* to the shaft hub portion 45. The inter-blade spacing region is an annulus bounded by the shaft hub portion 45 and the rotor hub portion 38 to define a fluid passageway 46 in communication with the central bore 42. The cylindrical block comprises two sets of transfer passages 52*a* and 52*b*; each set being a mirror-image of the other about a mid-transverse plane of the block. Each set comprises a plurality of angularly spaced apart transfer passages; each transfer passage is smoothly curved to provide fluid communication between one end of the rotor and the central bore. Each transfer passage of the set 52*a* comprises an opening 54*a* through the rotor side wall 41*a* and an opening through the bore annular wall, referred to as a transfer port 58*a*. Similarly, each transfer passage of the set 52*b* comprises an opening 54*b* through the rotor side wall 41*b* and an opening through the bore annular wall, referred to as a transfer port 58*b*. The cylindrical block also comprises a plurality of slots 62 axially extending therethrough and radially extending through the rotor block outer annular wall 43. These slots are alternatively disposed with transfer passages, so that a pair of adjacent slots encloses two mirror-imaged transfer passages 52*a* and 52*b*.

Figure 6:
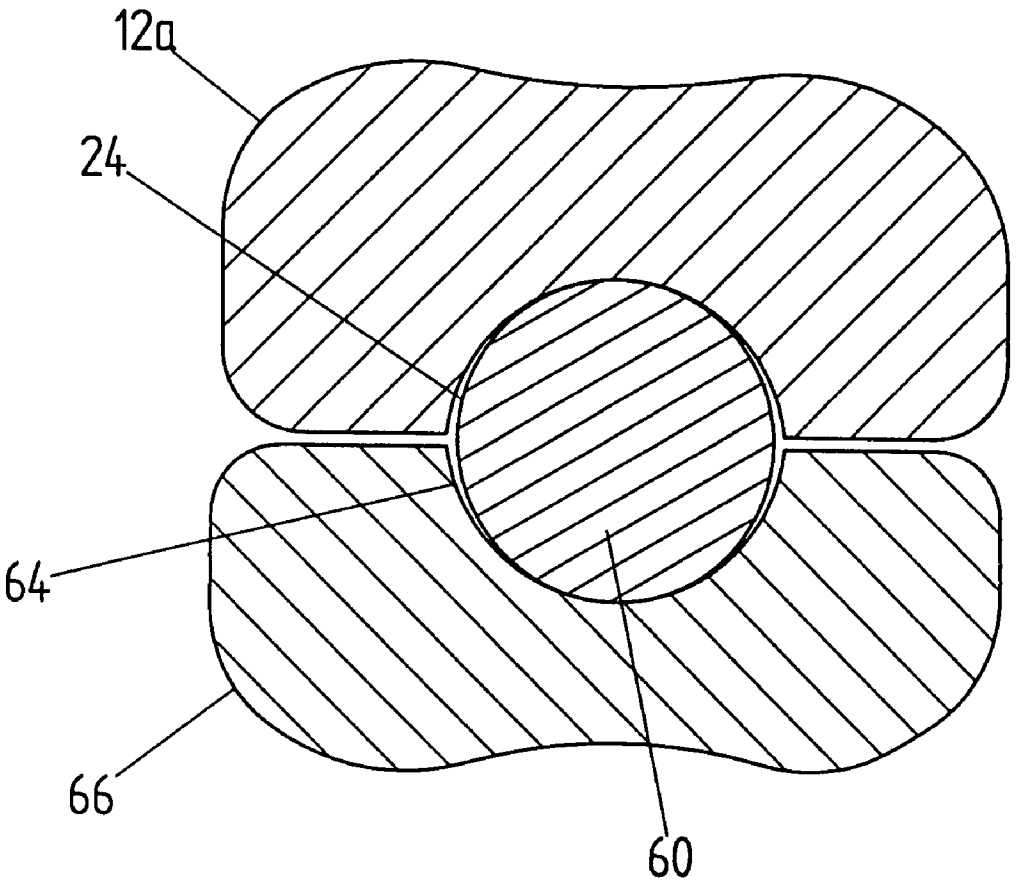
FIG. 6 is a schematic cross-section of a vane actuation mechanism of the axial vane rotary device of FIG. 1.
Figure 5:
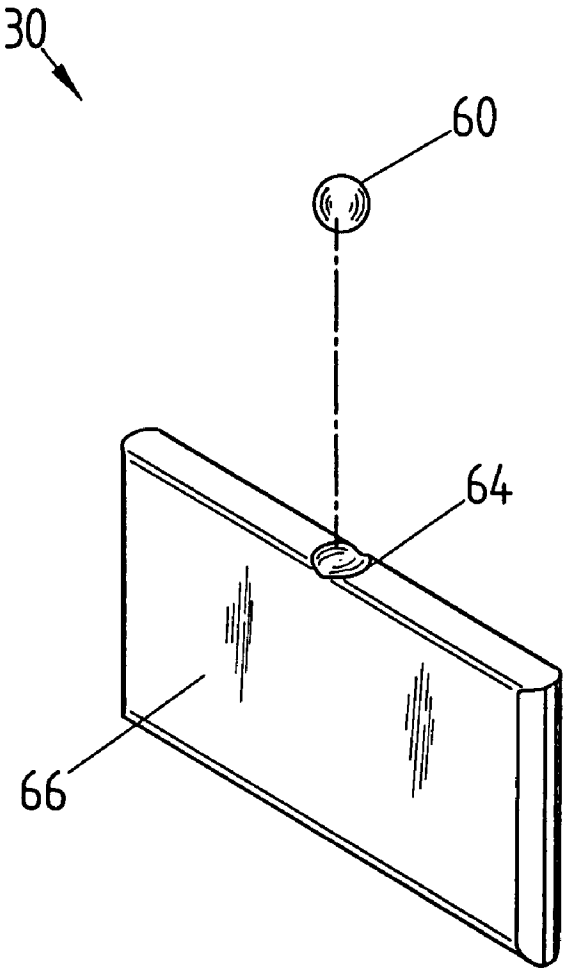
FIG. 5 is an exploded isometric view of the vane assembly of the axial vane rotary device of FIG. 1.

A plurality of vane assemblies 30, as shown in FIG. 5, are slidably and sealingly disposed in the rotor slots 62. Each of these vanes preferably comprises a rectangular plate portion 66, having tapered outer and side edges, which may include a spring biased seal (not shown). The side edges slidably engage the annular cam surfaces and the outer edge slidably engages the outer annular wall of the chamber. The outer edge of each vane comprises a predominantly hemispherical recess 64 adapted to slidably receive a ball element 60. The hemispherical recess partly encapsulates the inner half portion of the ball element, and the cam groove 24 formed in the external stator partly encapsulates the outer half portion of the ball element. When the rotor rotates, the ball element rollingly and slidably contacts the hemispherical recess 64 of the outer vane tip portion and the grooved wall portion. To actuate the vane it is necessary that the radius of the ball element be slightly greater than both the cam groove depth and the maximum depth of the hemispherical recess so that a small clearance is maintained between the outer edge of the vane and the outer annular wall of the chamber, as shown in FIG. 6. This clearance may be closed by a spring biased seal (not shown) making a sliding contact with the outer annular wall.

A vane actuation mechanism for synchronizing the reciprocating motion of the vanes may comprise guide cam grooves 24*a*, 24*b* in the annular wall of the upper and lower half stator portion 12*a*, 12*b*, respectively, and ball cam followers 60 engaging those cam grooves. The cam groove, which has the same profile shape as the undulating cam surface, is preferably disposed at the mid distance between the two cam surfaces. The ball element 60 is partly encapsulated within a predominantly hemispherical recess 64 at the middle of the vane outer tip. The ball is preferably made of a self-lubricating material. The depth of both the cam groove and the predominantly hemispherical recess is necessarily slightly less than the radius of the ball element so that a sliding clearance is maintained between the outer vane tip and the outer annular wall of the chamber. The effect of centrifugal force, when the rotor rotates, is to push the vane outward, causing the ball element 60 to make sliding and rolling engagement with the guide groove 24*a* and 24*b*, thus forcing the vanes to axially reciprocate with respect to the rotor. During rotation the outer and side vane tips make a small clearance engagement with the outer annular wall and the side undulating cam surfaces. Sealing (not shown) may be provided through spring biased seals at the outer and side tips for sealing and sliding engagement at these surfaces.

Figure 7:
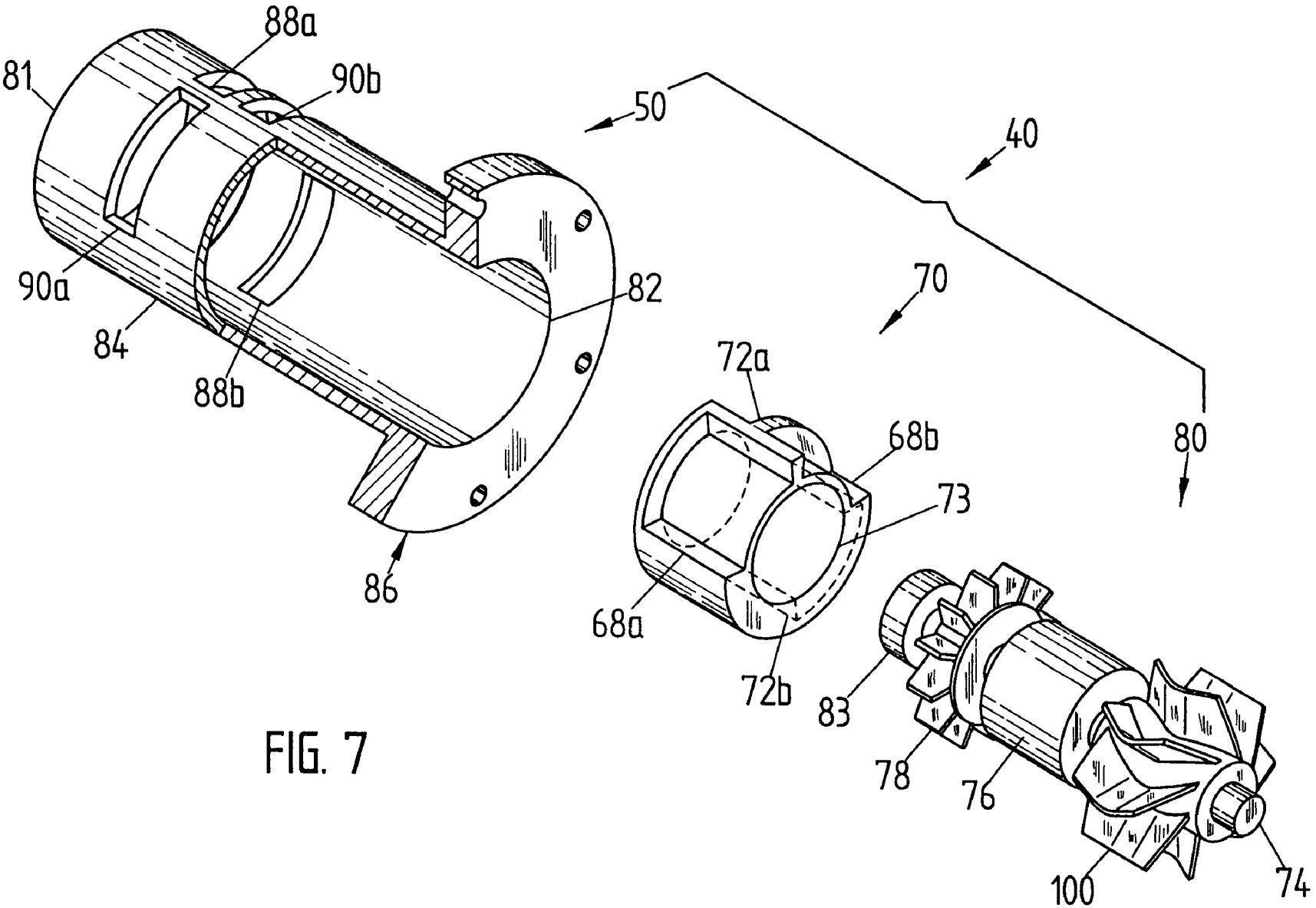
FIG. 7 is an exploded isometric view of an axial vane rotary device of the invention configured to operate as a four-phase internal combustion engine, wherein the rotary device comprises an inner stator portion having a turbocharger assembly.
Figure 8:
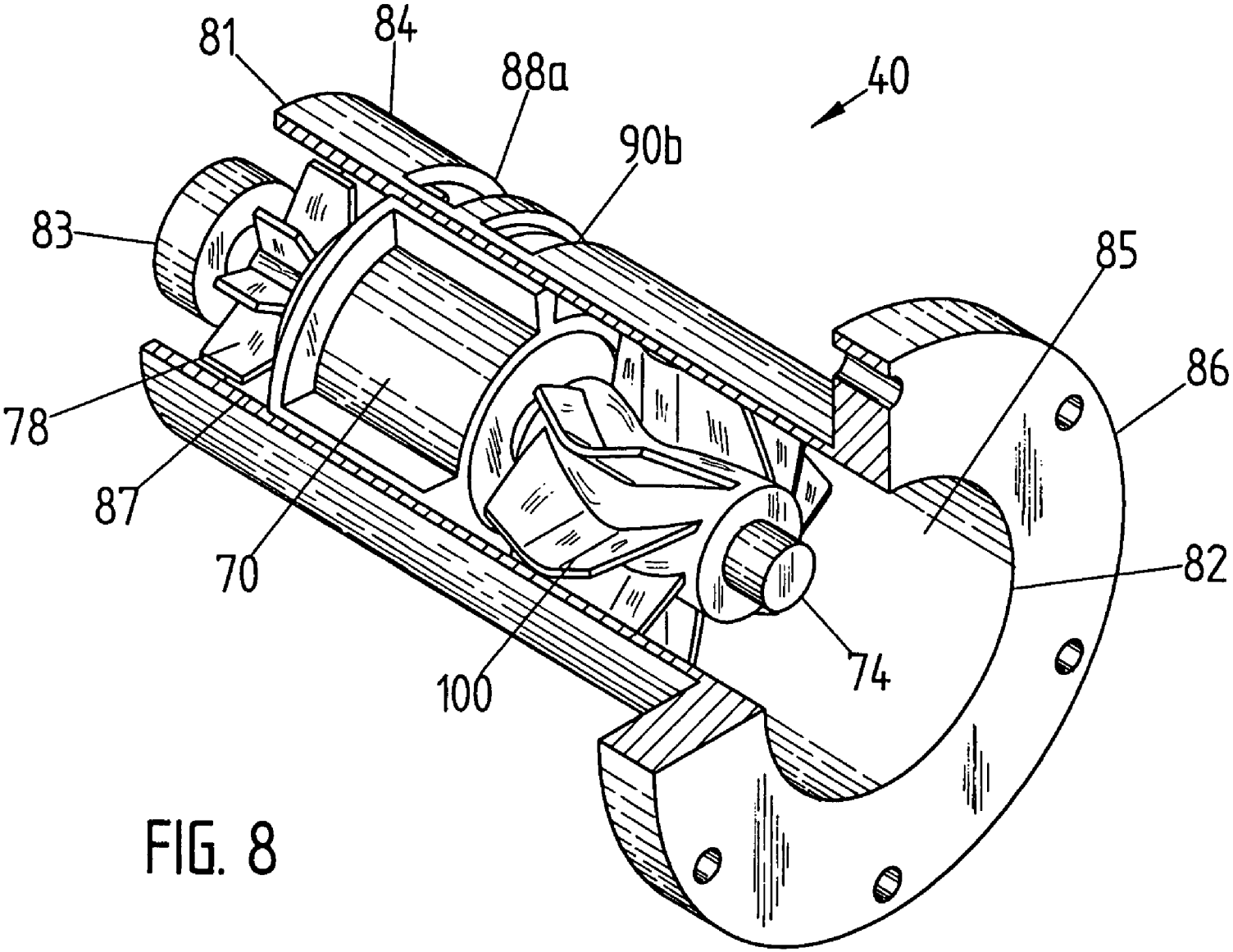
FIG. 8 is an isometric view of the inner stator and turbocharger assembly of an axial vane rotary device of the invention configured to operate as a four-phase internal combustion engine and having portions cut away for the purpose of illustration.
Figure 10A:
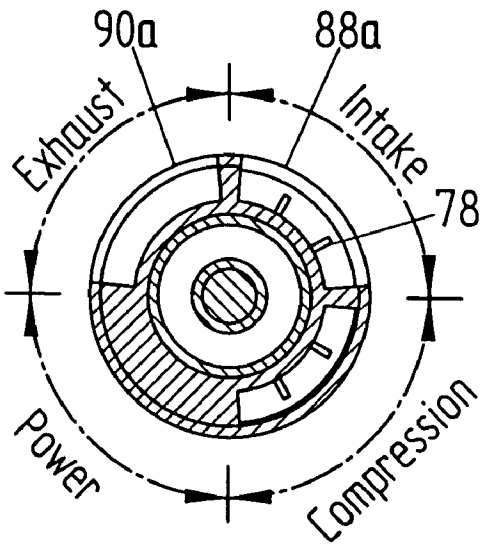
FIG. 10*a* is a cross-sectional view taken along line 10*a*—10*a* of FIG. 9.
Figure 10B:
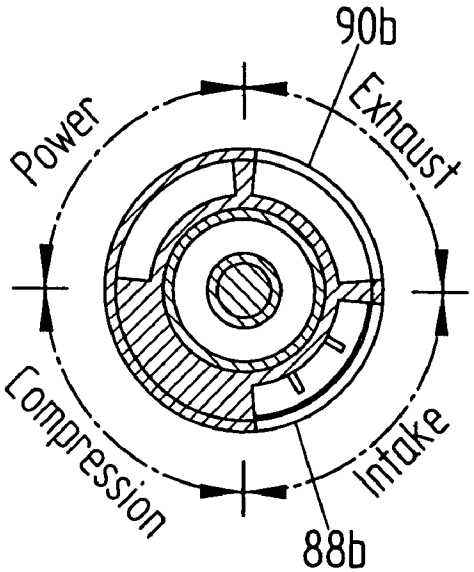
FIG. 10*b* is a cross-sectional view taken along line 10*b*—10*b* of FIG. 9.
Figure 9:
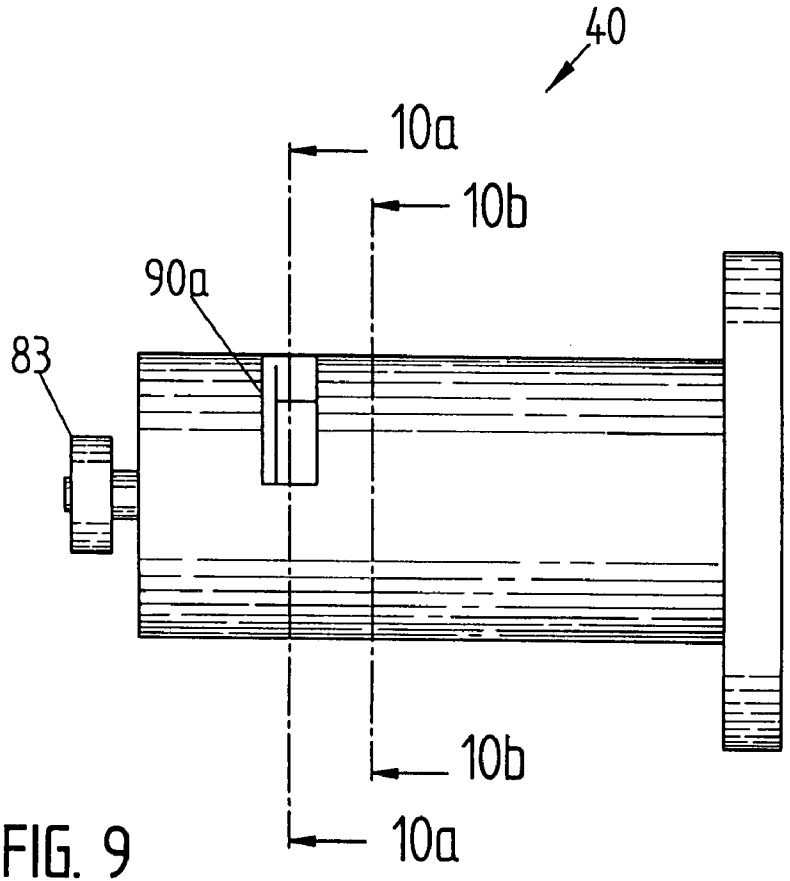
FIG. 9 is a side elevation view of the inner stator portion and turbocharger assembly of an axial vane rotary device of the invention configured to operate as a four-phase internal combustion engine.
Figure 11:
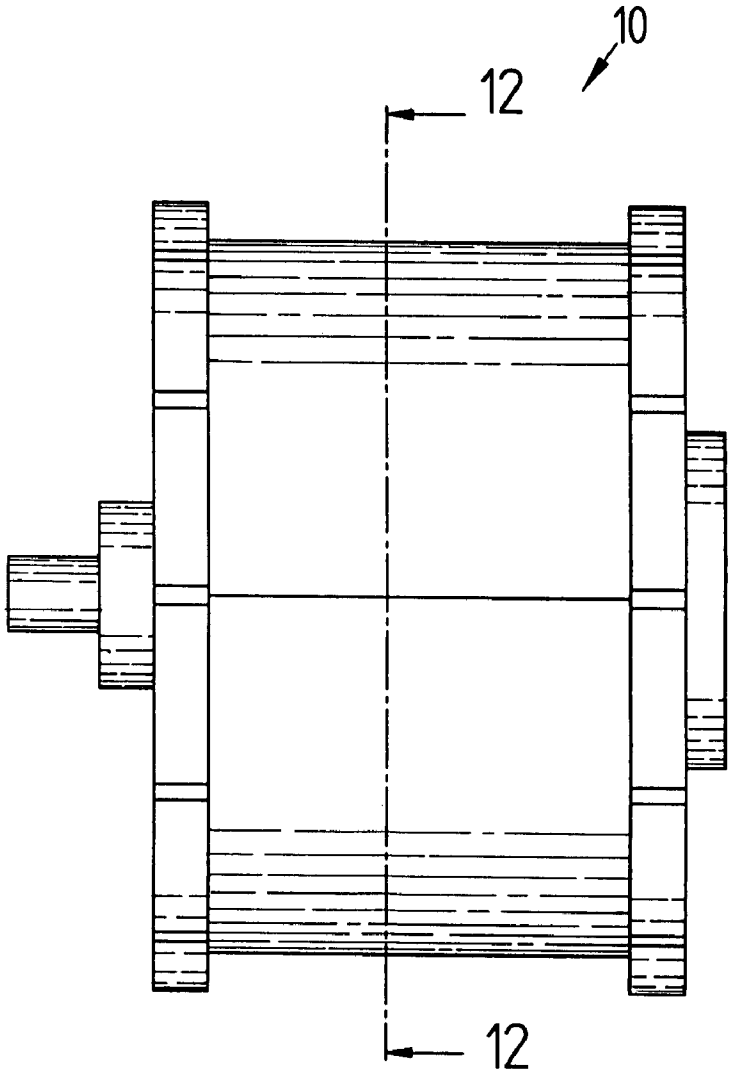
FIG. 11 is a side elevation view of an axial vane rotary device of the invention configured to operate as a four-phase internal combustion engine.
Figure 12:
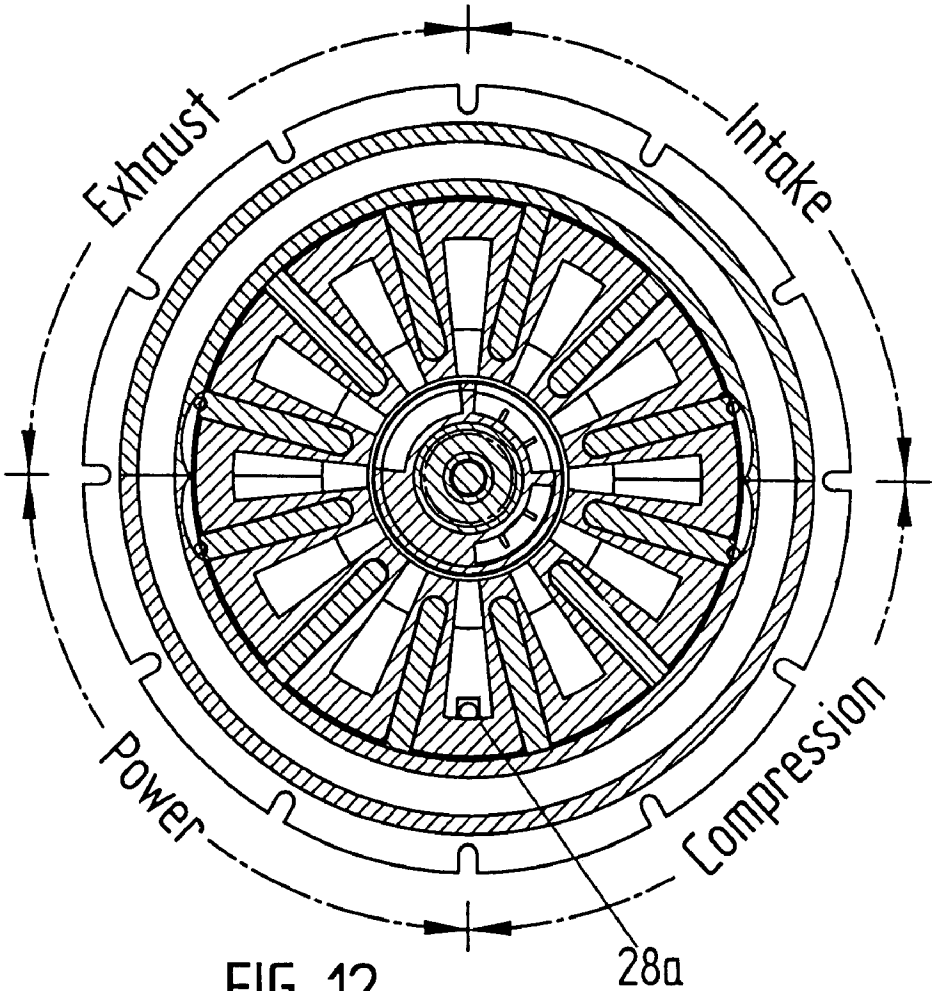
FIG. 12 is a sectional view taken along line 12—12 of FIG. 11.

An internal stator assembly 40, shown in FIG. 7 and FIG. 8, is configured for an axial vane rotary device of FIG. 1 that is to operate as a four-phase internal combustion engine. The assembly is co-axially mounted within the chamber along the shaft axis 18 through a central opening 32*b* in the end plate 16. The preferred internal stator assembly 40 for this configuration comprises an internal stator tube 50, an internal stator partitioning member 70 and a turbocharger assembly 80. The stator tube 50 comprises a tubular portion 84 having intake 81 and exhaust 82 openings; a first pair of angularly spaced apart intake 88*a* and exhaust 90*a* ports; and a second pair of ports 88*b*, 90*b* axially spaced apart from the first pair. The second pair 88*b*, 90*b* has a ninety degree phase shift relationship with respect to the first pair 88*a*, 90*a*. In addition, the assembly also comprises a flange portion 86 for fixing the stator portion to the end plate 16 at the preferred angular position by suitable fixture means (not shown) known in the engine assembly art. The internal stator partitioning member 70 is disposed within the tubular portion of the stator tube 50. The internal stator partitioning member 70 partitions the tubular internal stator into two channels. One is a common exhaust channel 85 having an end exhaust opening 82 in the flange portion 86 that is fixed to the end plate 16 opposite to the shaft end. The other is a common intake channel 87 having an end intake opening 81 proximal to the shaft end and in communication with intake openings 34 in the end plate 14. The partitioning member 70 comprises two peripheral intake cutouts 72*a* and 72*b* forming annular channels which connect intake ports 88*a* and 88*b* to the common intake channel 87, and also comprises two peripheral exhaust cutouts 68*a* and 68*b* forming annular channels which connect the exhaust ports 90*a* and 90*b* to the common exhaust channel 85. The turbocharger assembly 80 comprises a compressor impeller 78 and turbine rotor 100, a middle bearing 76 and an end bearing 83 which are all fixed to a common turbocharger shaft 74. The turbocharger assembly is rotatably carried by the middle bearing 76 within the partitioning member 70 central opening 73. One of the bearings 83 is a floating bearing having an inner race fixed to the end of the turbocharger shaft 76 and an outer race fixed within the rotor shaft recess 56 in order to provide additional support and axial alignment for the turbocharger assembly.

The operation of the axial vane rotary device as a four-phase internal combustion engine may be explained with reference to FIG. 9 through FIG. 12. The undulating cam surface 26*a*, together with the outer annular wall 23, the inner annular wall 31*a* and the rotor side wall 41*a*, defines four volumetric regions, such that each sub-volume region bounded by two adjacent vanes enclosing a transfer passage 52*a* goes through volumetric variation comprising two increasing volume regions alternated by two decreasing volume regions as the rotor makes one complete rotation. Similarly, the undulating cam surface 26*b*, together with outer annular wall 23, inner annular wall 31*b* and rotor side wall 41*b*, defines four volumetric regions, such that the sub volume region bounded by two adjacent vanes enclosing a transfer passage 52*b* goes through volumetric variation comprising two increasing volume regions alternated by two decreasing volume regions each time the rotor completes one revolution. The process sequence occurring proximal to the shaft end for a sub-volume enclosed between two adjacent vanes comprises an intake phase in which a first increasing volume region has a transfer port 58*a* communicating with an intake port 88*a*. This is followed by a compression phase in which a first decreasing volume region has a transfer port 58*a* blocked by the outer annular wall of the inner tubular stator portion 84. This, in turn, is followed by an ignition initiated by an ignition means disposed at an ignition port 28*a*. Ignition is followed by a power or expanding phase during which the transfer port 58*a* is again blocked by the outer annular wall of the inner stator portion 84. Finally, there is an exhaust phase in which a second decreasing volume region has a transfer port 58*a* in communication with the exhaust port 90*a*. The impelling force of rotation during the power phase portion of the process sequence comes from the net pressure forces acting on the differential area of two adjacent vanes in the direction of increasing volume. The process sequence at the opposite shaft end goes through similar process sequence except that it lags by ninety degrees so that the intake process commences at the termination of the intake process at the shaft end. Thus, the process sequence occurring at the opposite shaft end comprises an intake phase in which a first increasing volume region has a transfer port 58*b* communicating with intake port 88*b*; a compression phase in which a first decreasing volume region has a transfer port 58*b* blocked by the outer annular wall of the inner stator portion 84; an ignition initiated by ignition means disposed at the ignition port 28*b*; a power or expanding phase in which the a second increasing volume region has the transfer port 58*b* blocked by the outer annular wall of the inner stator portion 84; and, finally, an exhaust phase in which a second decreasing volume region has a transfer port 58*a* in communication with the exhaust port 90*a*.

Figure 13:
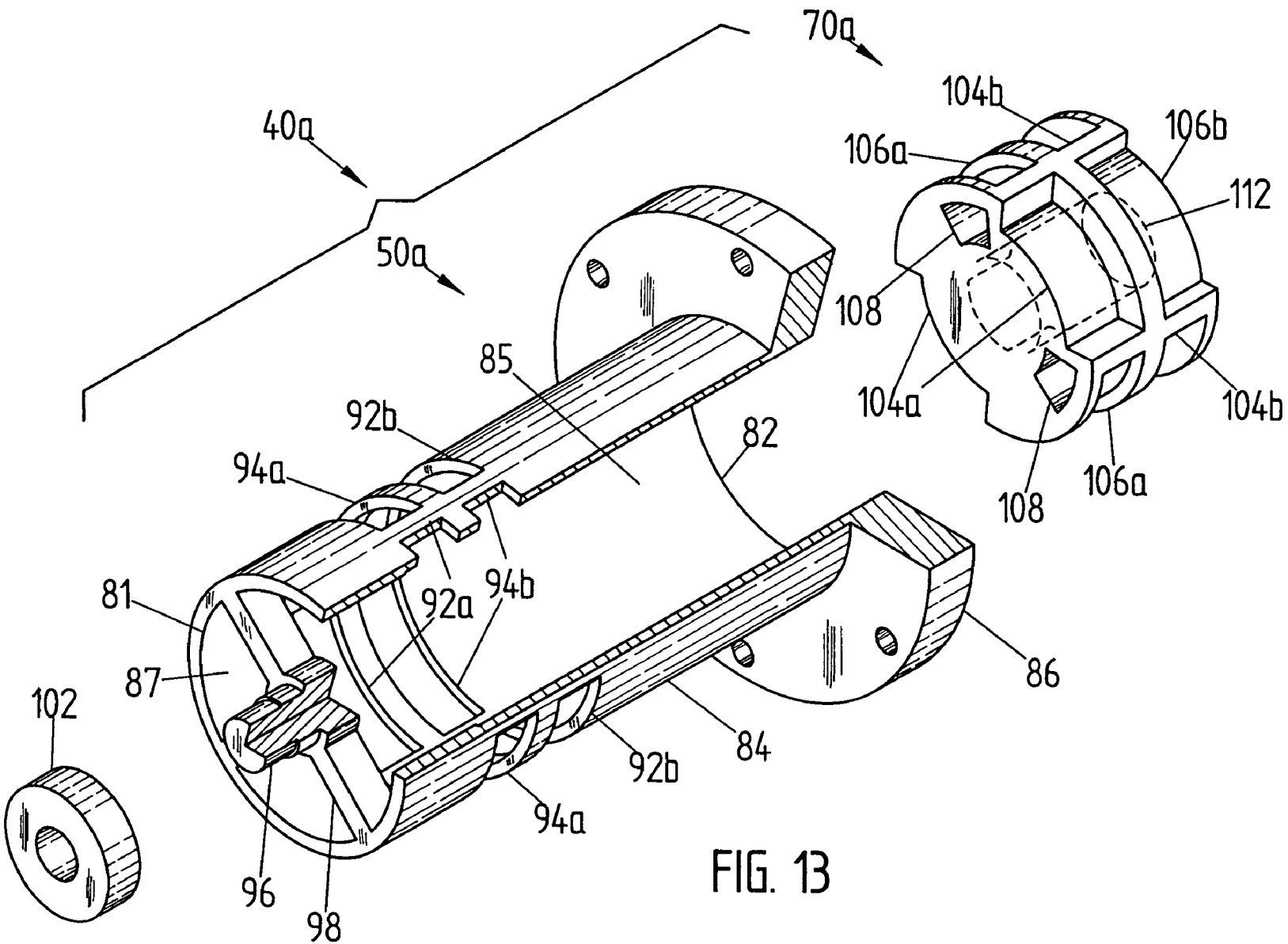
FIG. 13 is an exploded isometric view of the inner stator portion of an axial vane rotary device of the invention having four intake and four discharge ports, the device configured to operate as one of a pump, a compressor, and an expander.
Figure 14:
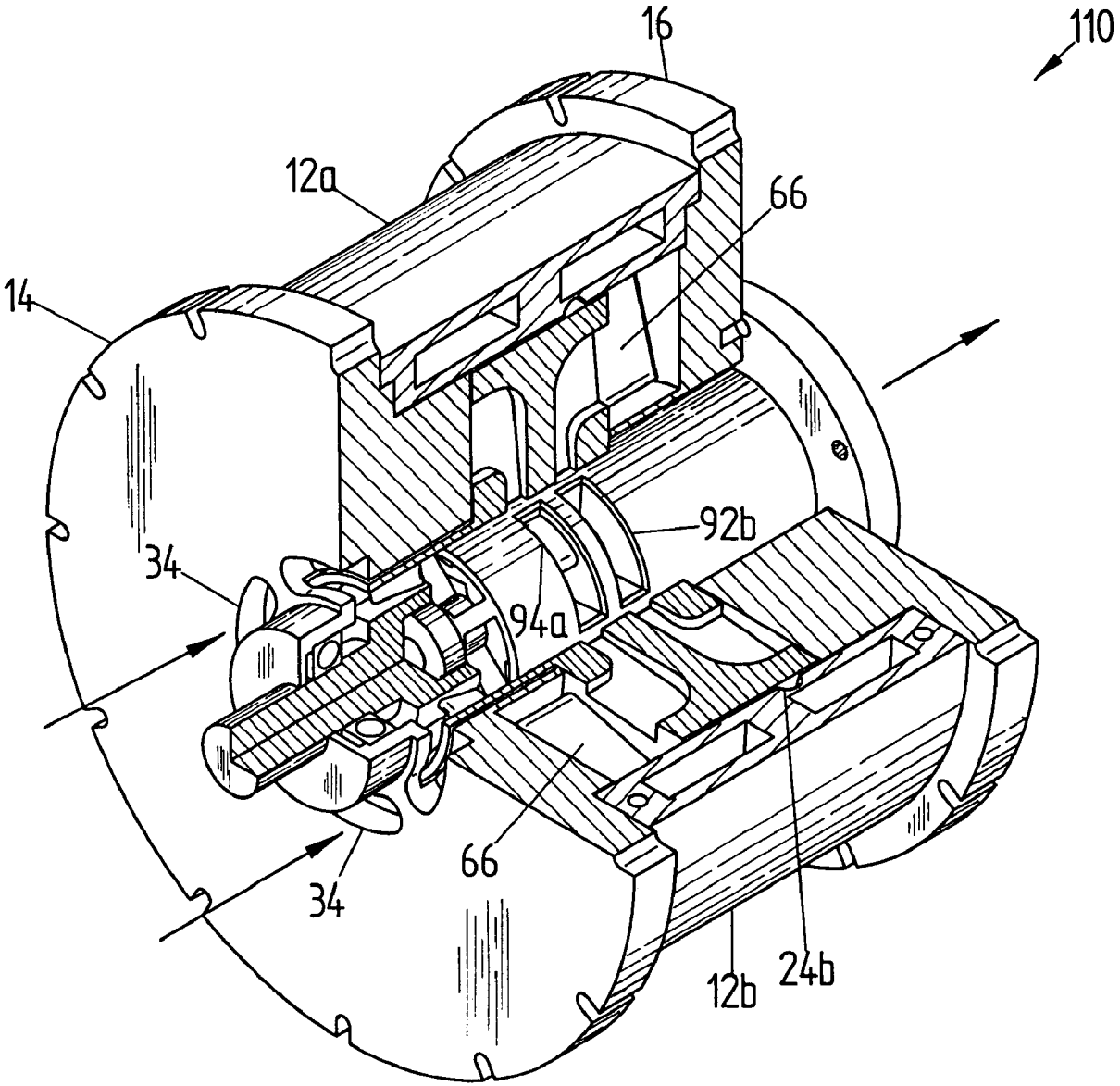
FIG. 14 is an isometric view of an axial vane rotary device of the invention having the inner stator assembly of FIG. 12 and having the stator and rotor cut away for the purpose of illustration.

Another embodiment of the axial vane rotary device is configured to operate as one of a pump, a compressor and an expander 110 by replacing the inner stator assembly 40, depicted in FIG. 1, with a different inner stator assembly 40*a*, as depicted in FIG. 13 and FIG. 14. The inner stator assembly 40*a* comprises a stator tube 50*a* which comprises a tubular portion 84 and a flange end portion 86 fixedly attached to the back end plate 16 by suitable fixture means (not shown). The tubular portion comprises two sets of ports axially spaced apart. A first set, relatively proximal to the shaft end, comprises two diametrically opposite intake ports 92*a* alternated by two diametrically opposite exhaust or discharge ports 94*a*. A second set relatively distant from the shaft end comprises two diametrically opposite intake ports 92*b* alternated by two diametrically opposite discharge ports 94*b*. This second set has a ninety degree phase shift relationship with respect to the first set. The partitioning member 70*a*, comprising a cylindrical block with a number of annular cutouts and bored regions, is fixedly disposed within the tubular portion 84 of the stator tube 50*a* by fixture means (not shown). This stator partitioning member 70*a* partitions the tubular portion 84 into a common intake channel 87 relatively close to the intake end opening 81 and a common exhaust or discharge channel 85 relatively close to the exhaust or discharge end opening 82. The partitioning member 70*a* provides first intake cutouts 104*a* and second intake cutouts 104*b* inwardly connected to a bored passage 108. Both the first and the second intake cutouts are in communication with the common intake channel 87, which is in communication with the opening 34 in the front end plate 14. Also, the first exhaust or discharge cutout 106*a* is inwardly connected to the bored channel 112 and to the second discharge cutout 106*b*. Both the first and the second discharge cutouts are in communication with the common discharge channel 85 connected to the end opening 82. The stator tube 50*a* comprises a stub shaft portion 96 fixed to the tubular portion 84 by radiating support members 98. A bearing 102 has an inner race carried by the stub shaft portion and an outer race disposed in a recess 56 of the rotor assembly 20 to provide support and axial alignment of the internal stator assembly 40*a*.

Figure 16A:
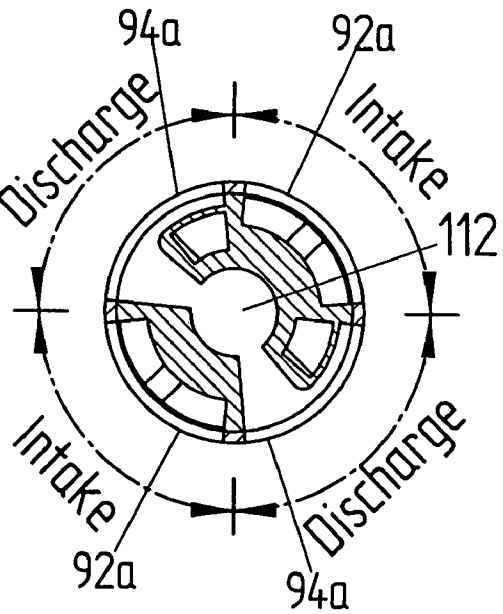
FIG. 16*a* is a cross-sectional view taken along line 16*a*—16*a* of FIG. 15.
Figure 16B:
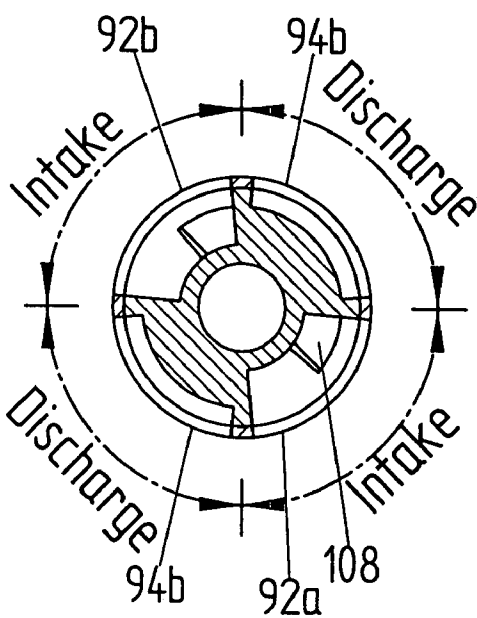
FIG. 16*b* is a cross-sectional view taken along line 16*b*—16*b* of FIG. 15.
Figure 15:
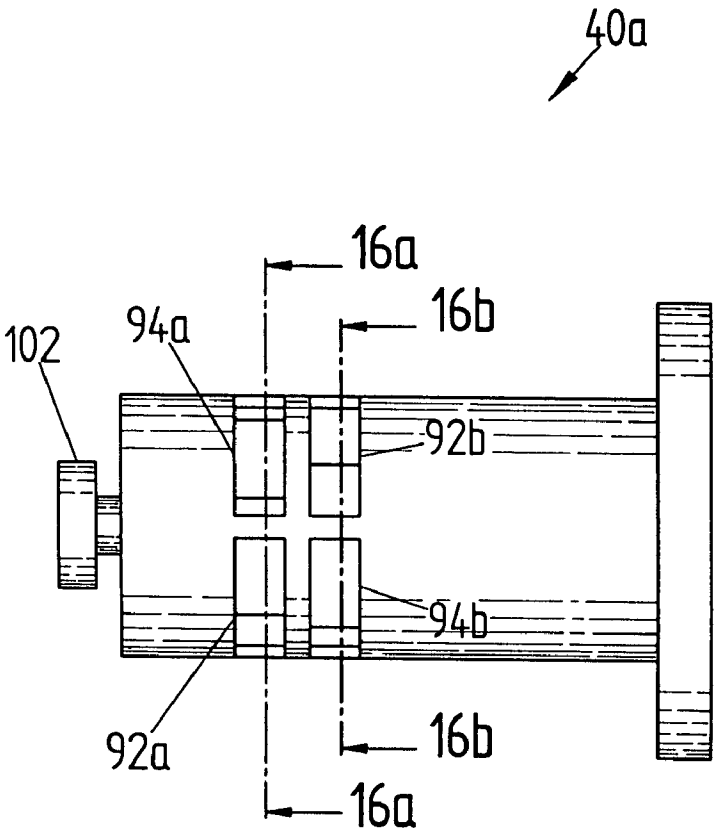
FIG. 15 is a side elevation view of the inner stator portion of FIG. 13 for an axial vane rotary device configured to operate as one of a pump, a compressor, and an expander.

The operation of the axial vane rotary device 110 as one of a pump, a compressor and an expander is illustrated by FIGS. 15, 16*a*, and 16*b*. Operation as a pump or compressor is made by coupling the rotor shaft 44 to a source of rotation, such as a motor (not shown), to cause rotation of the rotor and axial reciprocation of the vanes with respect to the rotor. This provides a process sequence of two diametrically opposite intake phases alternated by two diametrically opposite exhaust or discharge phases occurring at both ends. When operating as an expander device or fluid driven motor, a fluid source of high pressure is connected to an intake opening 34, and the impelling net pressure forces on the vanes causes rotation of the rotor and discharge of an energy-expended fluid. The process sequence occurring proximal to the shaft end comprises a first intake phase in which a first increasing volume region has a transfer port 58*a* communicating with an intake port 92*a*. This is followed by a first discharge phase in which a first decreasing volume region communicates with an exhaust or discharge port 94*a*. This, in turn, is followed by a second intake phase in which a second increasing volume region has a transfer port 58*a* communicating with the intake port 92*a*. Finally, there is a second discharge phase in which a second decreasing volume region has the transfer port 58*a* in communication with the discharge port 94*a*. The process sequence at the opposite shaft end goes through a similar process sequence except that it lags by ninety degrees so that each intake phase at one end commences at the termination of an intake phase at the other end. Thus, the process sequence occurring opposite to the shaft end comprises a first intake phase in which a first increasing volume region has a transfer port 58*b* communicating with intake port 92*b*; a first discharge phase in which a first decreasing volume region communicates with the discharge port 94*b*; a second intake phase in which a second increasing volume region has a transfer port 58*b* communicating with the intake port 92*b*; and, finally, a second discharge phase in which a second decreasing volume region has the transfer port 58*b* in communication with the discharge port 94*b*.

Figure 17:
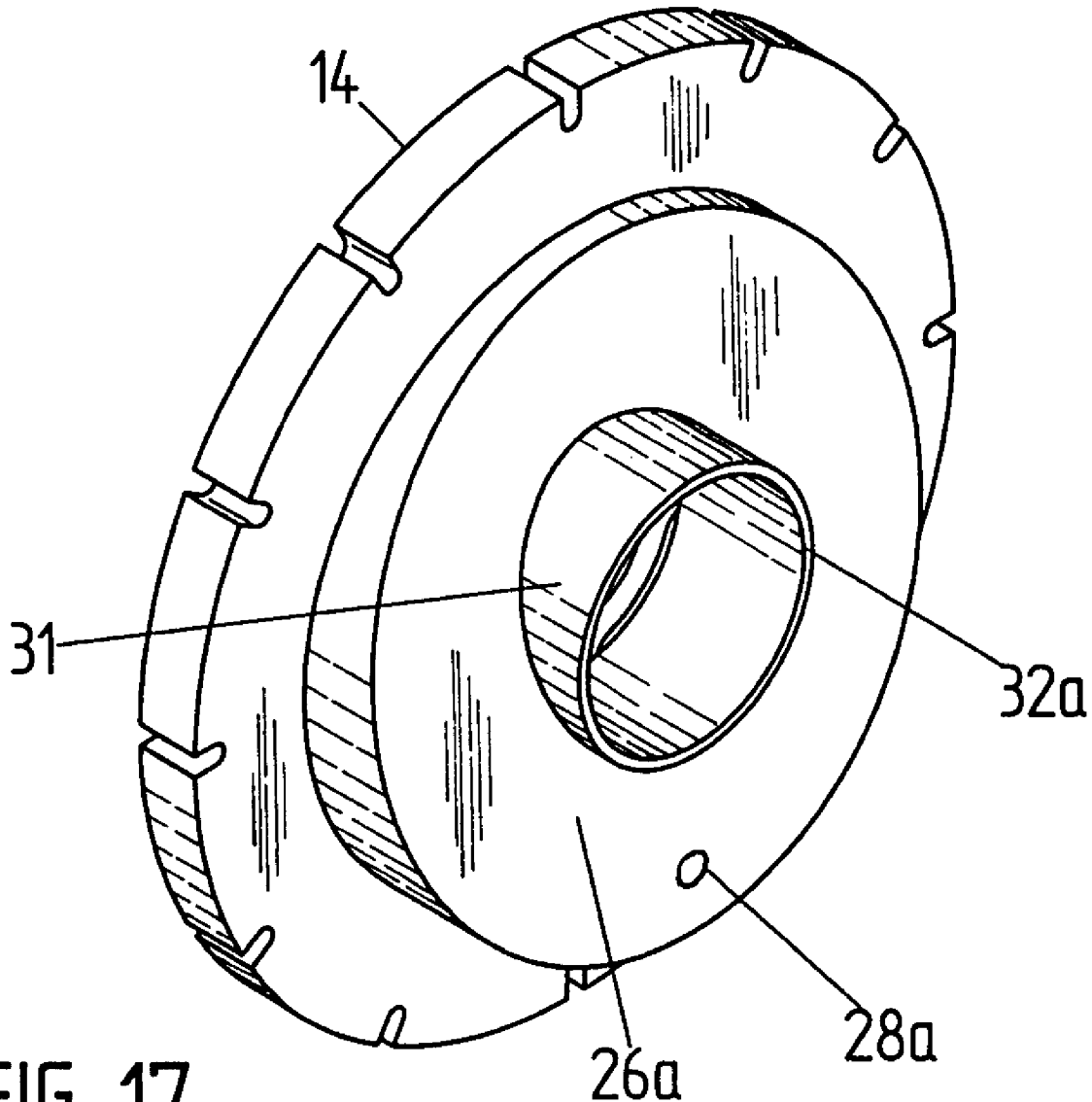
FIG. 17 is an alternative end cam surface profile corresponding to a two-phase axial vane rotary device of the invention.
Figure 18:
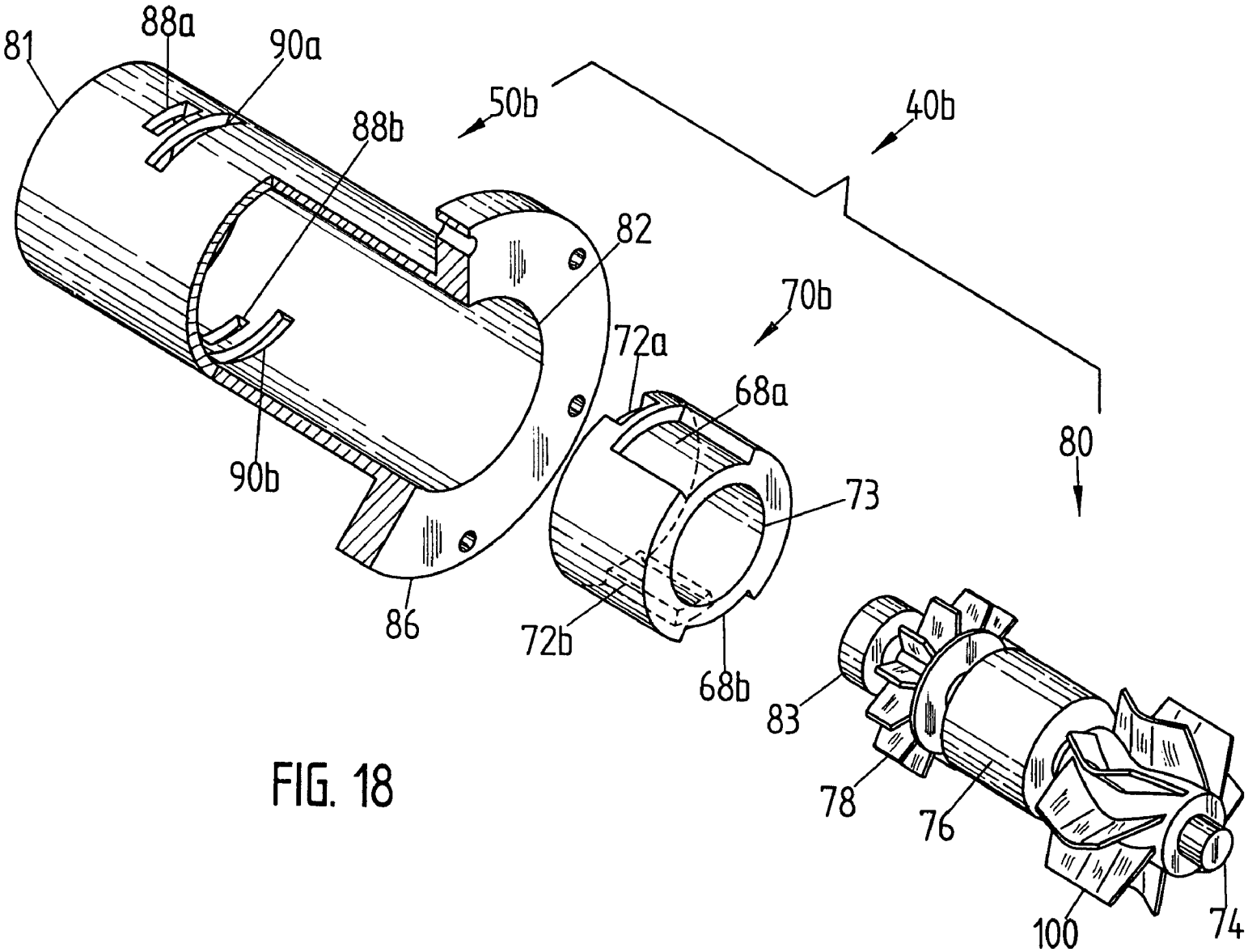
FIG. 18 is an exploded isometric view of the inner stator and turbocharger assembly of an axial vane rotary device of the invention configured to operate as a two-phase internal combustion engine.
Figure 19:
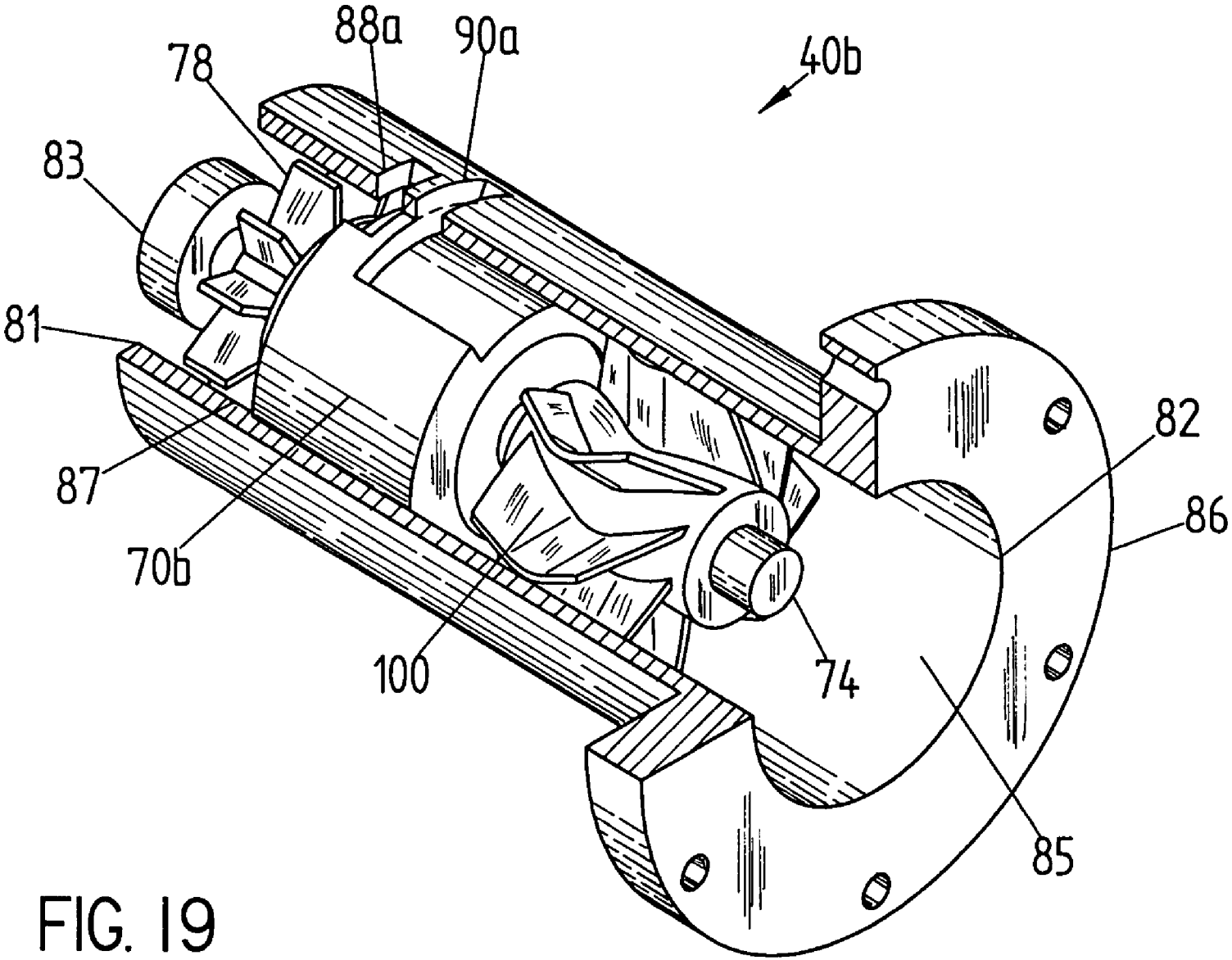
FIG. 19 is an isometric view of the inner stator and turbocharger assembly of an axial vane rotary device of the invention configured to operate as a two-phase internal combustion engine, the view having portions cut away for the purpose of illustration.

Another embodiment of the axial vane rotary device 10 is one configured to operate as a two-phase internal combustion engine. In this device the end plates are replaced with ones having the cam surface profile shown in FIG. 17 where each cam surface, for example 26*a*, comprises a first portion relatively distant from the respective end plate and a second portion relatively proximal to the respective end plate. The first portion of one end plate is aligned with the second portion of the opposite end plate so that the axial gap distances between cam surfaces remain fixed while traversing a circular path around the axis of the device. Each cam surface comprises an ignition port, for example 28*a*, for receiving an igniter (not shown) disposed within the first portion. For this embodiment, the internal stator assembly 40 is replaced with the internal stator turbocharger assembly 40*b*, as shown in FIG. 18 and FIG. 19. The internal stator assembly 40*b* comprises the stator tube 50*b*, a partitioning member 70*b* and the turbocharger assembly 80. The stator tube 50*b* comprises a tubular portion 84 comprising two sets of ports axially spaced apart. A first set of ports relatively proximal to the end intake opening 81 comprise an intake port 88*a* axially adjacent to an exhaust port 90*a* so that the intake port 88*a* has a smaller angular extension overlapping with the exhaust port 90*a*. A second set of ports relatively proximal to the end exhaust opening 82 comprise an intake port 88*b* axially adjacent to an exhaust port 90*b* so that the intake port 88*b* has a smaller angular extension overlapping with the exhaust port 90*b*, and so that the second set is disposed at a one hundred eighty degree phase shift with respect to the first set. The internal stator partitioning member 70*b* is disposed within the tubular portion of the stator tube 50*b* by fixture means (not shown). The internal stator partitioning member 70*b* partitions the cylindrical internal volume into two channels, a common exhaust channel 85 with exhaust opening 82 in the end plate 16 and a common intake channel 87 with end intake opening 81 in communication with the plate 14 intake openings 34 proximal to the rotor shaft end. The partitioning member 70*b* comprises two peripheral intake cutouts 72*a*, 72*b* forming annular channels which connect the intake ports 88*a* and 88*b* to the common intake channel 87, and also comprises two peripheral exhaust cutouts 68*a*, 68*b* forming exhaust channels which connect the exhaust ports 90*a*, 90*b* to the common exhaust channel 85. The turbocharger assembly 80 comprises a compressor impeller 78, a turbine rotor 100, a middle bearing 76 and an end bearing 83, which are all fixed to the common turbocharger shaft 74. The turbocharger assembly is rotatably carried by the middle bearing 76 within the central opening 73 of the partitioning member 70*b*. A bearing 83 is rotatably mounted with an inner race fixed to the end of turbocharger shaft 76 and an outer race fixed within the rotor shaft recess 56 in order to provide additional support and axial alignment for the turbocharger assembly.

Figure 21A:
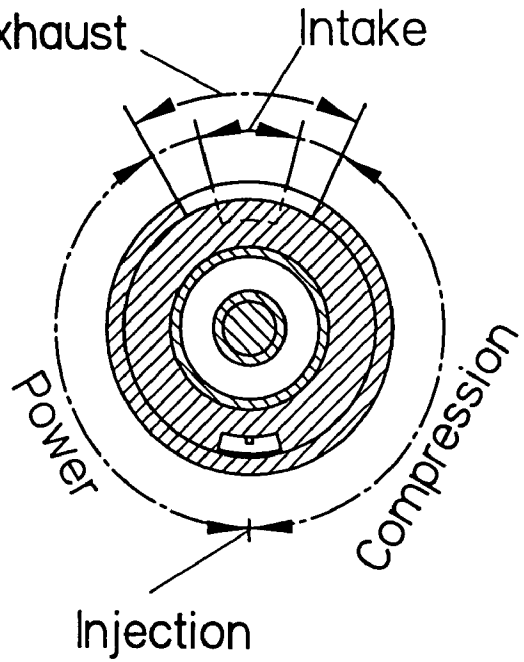
FIG. 21*a* is a cross-sectional view taken along line 21*a*—21*a* of FIG. 20.
Figure 21B:
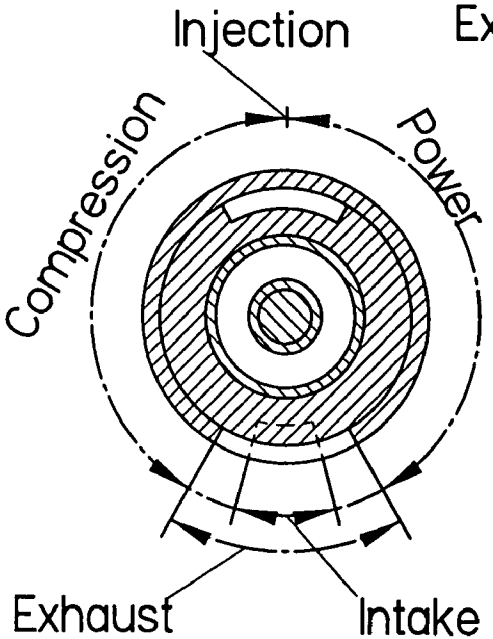
FIG. 21*b* is a cross-sectional view taken along line 21*b*—21*b* of FIG. 20.
Figure 20:
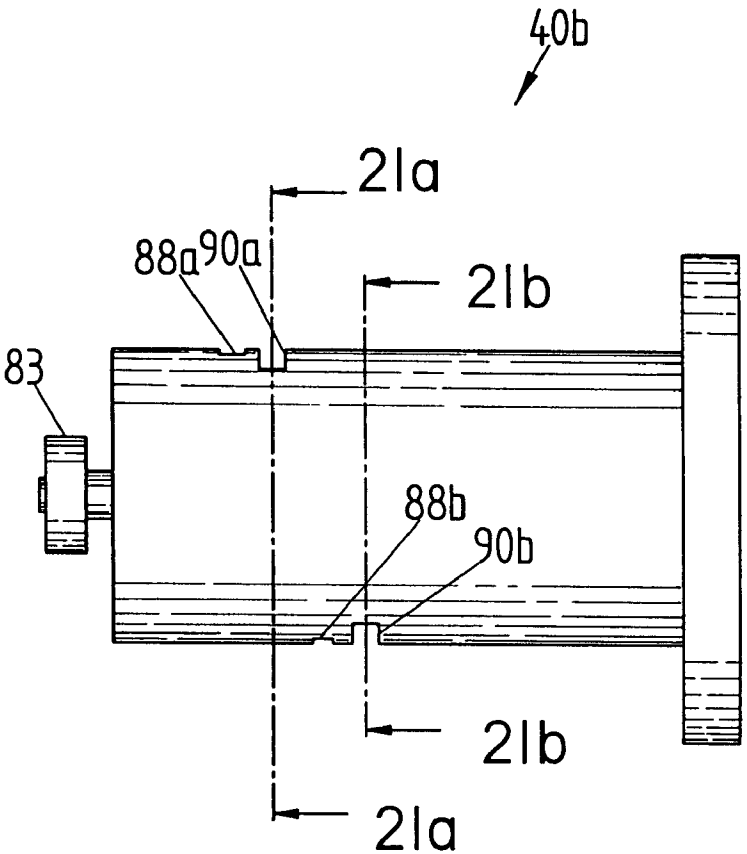
FIG. 20 is a side elevation view of the inner stator portion and turbocharger assembly of FIG. 18.

The operation of the axial vane device 10 as a two cycle internal combustion engine is illustrated with reference to FIG. 20, FIG. 21*a* and FIG. 21*b*. The undulating cam surface 26*a* of FIG. 17 proximal to the shaft end, together with the outer annular wall 23, inner annular wall 31*a* and rotor side wall 41*a*, defines two volumetric regions, such that the sub-volume region bounded by two adjacent vanes enclosing a transfer passage 52*a* that goes through volumetric variation comprising one increasing volume region followed by one decreasing volume region as the sub-volume traverses a circle about the axis of rotation 18. Similarly, the undulating cam surface 26*b* relatively proximal to the end plate 16 opposite to the shaft end defines, together with the outer annular wall 23, the inner annular wall 31*b*, and the rotor side wall 41*b*, two volumetric regions arranged so that the sub-volume region bounded by two adjacent vanes enclosing a transfer passage 52*b* goes through volumetric variation comprising one increasing volume region followed by one decreasing volume region as the rotor complete one revolution. In this arrangement an increasing volume variation of one side corresponds to a decreasing volume variation in the axially opposite end and vice versa. The process sequence occurring proximal to the shaft end comprises an expansion (power) phase taking place over the significant portion of the increasing volume region having a transfer port 58*a* blocked by the outer annular wall of the tubular portion 84 of the inner stator. Proximal to the end of the increasing volume region the transfer port 58*a* starts communicating with the exhaust port 90*a*, resulting in the blow down process which is followed by a scavenging process in which the transfer port 58*a* simultaneously communicates with both the intake port 88*a* and the exhaust port 90*a*, thus causing the replacement of the combustion products with a fresh intake charge. The scavenging process extends into a small portion of the decreasing volume region and is followed by the compression phase in which the transfer port 58*a* is again blocked by the tubular inner stator portion 84. Proximal to the end of the decreasing volume region, corresponding to a minimum volume, the compressed charge is ignited either due to self-ignition or by an igniter (not shown) disposed within an ignition port 28*a*. A similar process takes place at the opposite end relatively distant from the shaft end but with a phase shift of one hundred eighty degrees of arc.

Figure 22:
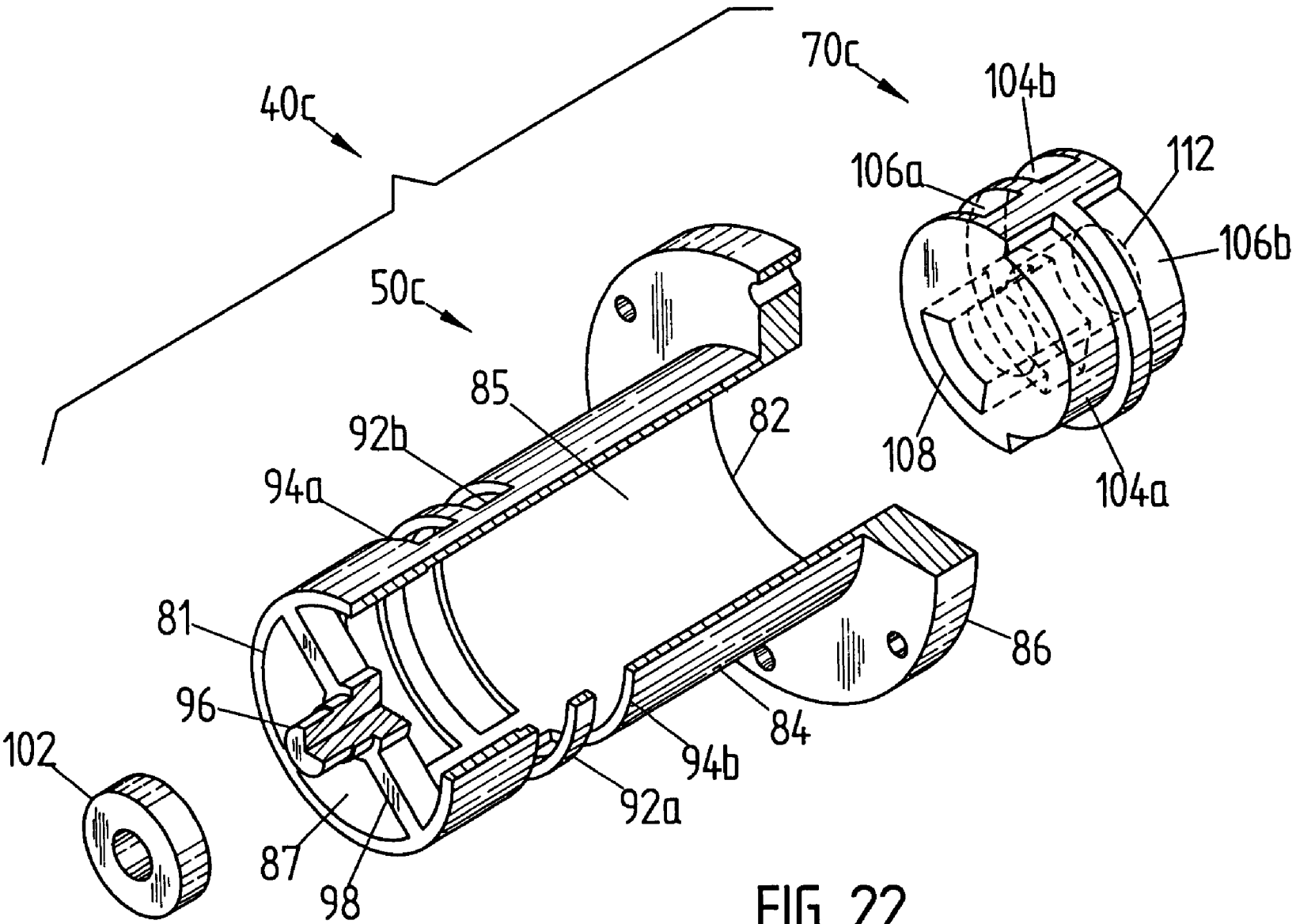
FIG. 22 is an exploded isometric view of the inner stator portion of an axial vane rotary device of the invention having double intake and double discharge ports and configured to operate as one of a pump, a compressor, and an expander.
Figure 23:
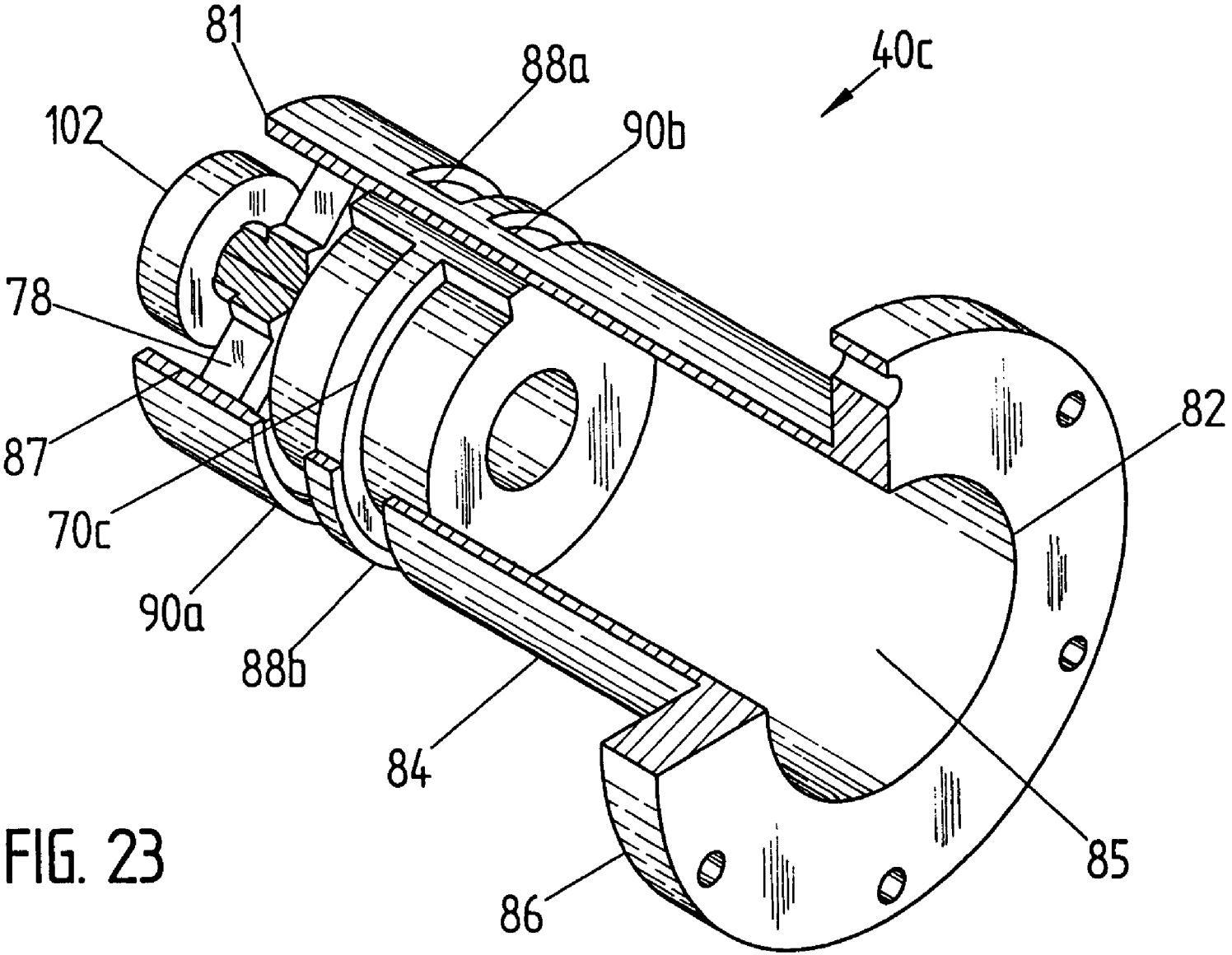
FIG. 23 is an isometric view of the inner stator portion of an axial vane rotary device of the invention configured to operate as one of a pump, a compressor, and an expander with double intake and double discharge ports, where a potion of the device is cut away for the purpose of illustration.

Still another embodiment of the axial vane rotary device of FIG. 1 is one configured to operate as one of a two-phase pump, a compressor, an expander and a fluid-driven motor device. In these configurations the internal stator assembly 40*b* of the two cycle internal combustion engine is replaced with a different internal stator assembly 40*c*, as shown in FIG. 22 and FIG. 23. The inner stator assembly 40*c* comprises a stator tube 50*c* which comprises a tubular portion 84 and a flange end portion 86 fixedly attached to an end plate 16 by fixture means (not shown). The tubular portion comprises two sets of ports axially spaced apart. A first set, proximal to the intake end opening 81, comprises an intake port 92*a* angularly adjacent to a discharge port 94*a*. A second set distal from the end opening 81 comprises an intake port 92*b* angularly adjacent to a discharge port 94*b*. The second set 92*b*, 94*b* has a one hundred eighty degree phase shift relationship with respect to the first set 92*a*, 94*a*. The stator partitioning member 70*c* comprises a cylindrical block having a number of annular cutouts and bored regions fixedly disposed within the stator tubular portion 84 of the stator tube 50*c* by fixture means (not shown). The partitioning member 70*c* partitions the tubular internal volume into a common intake channel 87 proximal to the end opening 81 and a common discharge channel 85 proximal to the other end opening 82. The stator partitioning member 70*c* comprises a first intake cutout 104*a* in communication with the intake port 92*a* and a second intake cutout 104*b* connected to a bored portion 108. Both intake cutouts communicate with the common intake channel 87. Also, the partitioning member 70*c* comprises a first discharge cutout 106*a* inwardly connected to the bored channel 112 and in communication with the discharge port 94*b*, and a second discharge cutout 106*b* in communication with the discharge port 94*b*. Both discharge cutouts communicate with the common discharge channel 85 proximal to the end opening 82. The stator tube 50*a* comprises a stub shaft portion 96 fixed to the tubular portion 84 by radiating support members 98. The stator assembly 40*c* also comprises a bearing 102 with an inner race carried by the stub shaft portion and an outer race disposed in a recess 56 within the rotor shaft hub portion of the rotor assembly 20.

Figure 25A:
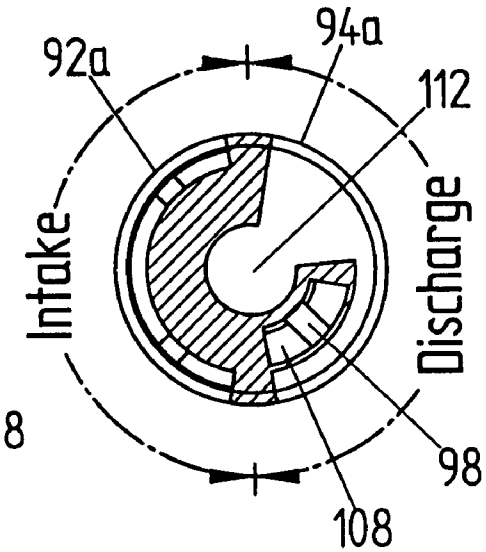
FIG. 25*a* is a cross-sectional view taken along line 25*a*—25*a* of FIG. 24.
Figure 25B:
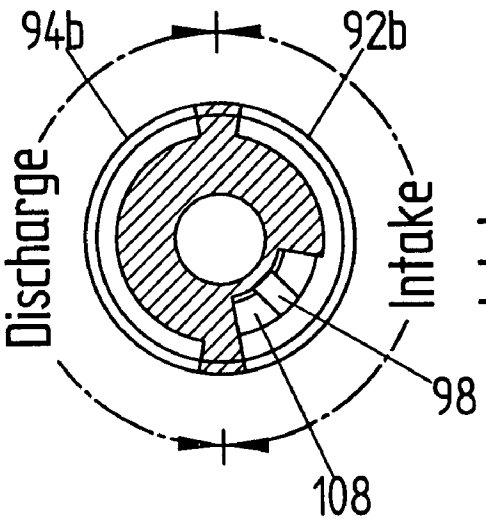
FIG. 25*b* is a cross-sectional view taken along line 25*b*—25*b* of FIG. 24.
Figure 24:
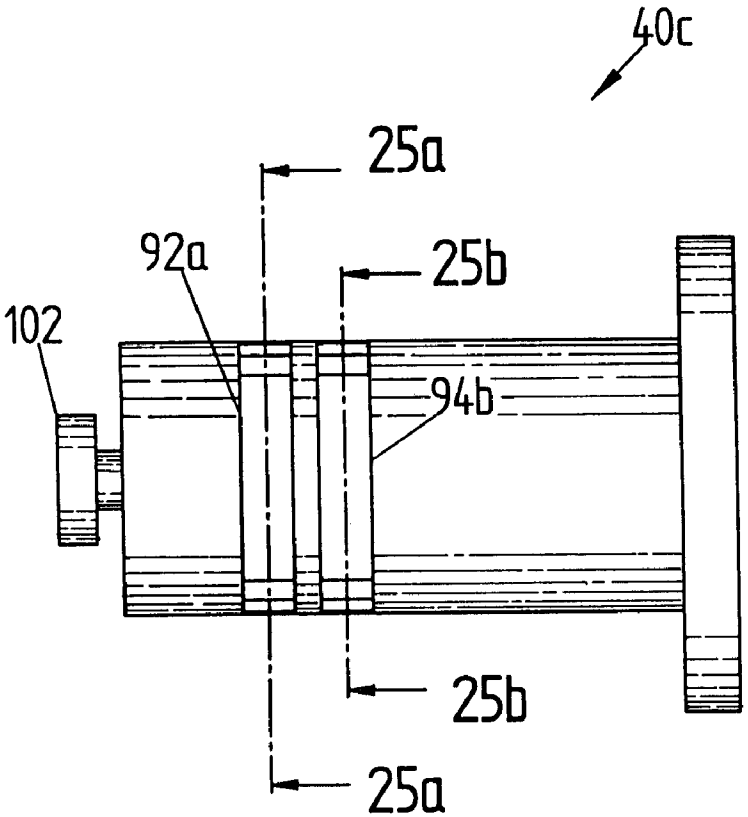
FIG. 24 is a side elevation view of the inner stator assembly portion of FIG. 23.
Figure 26:
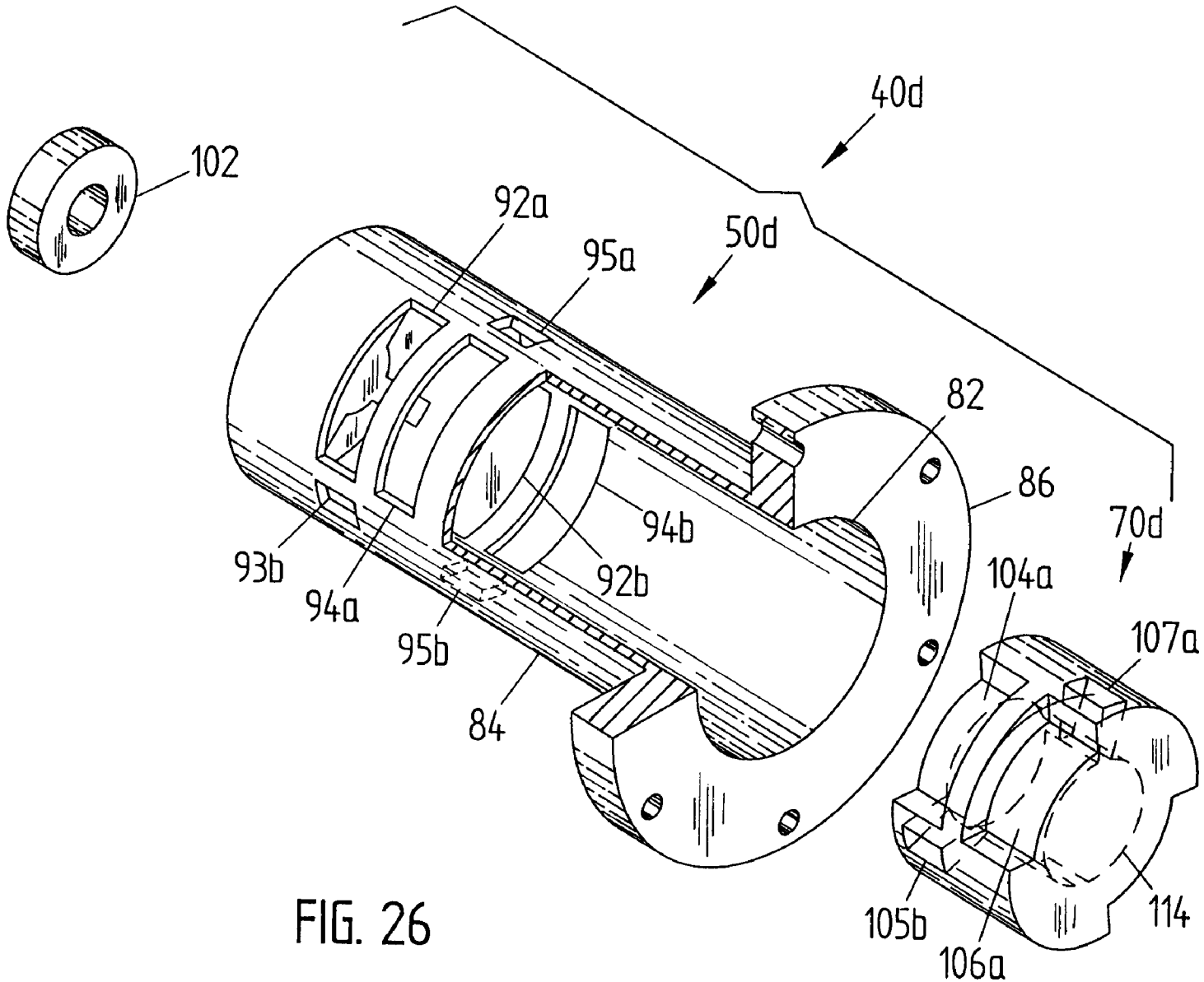
FIG. 26 is an exploded isometric view of the inner stator portion of an axial vane rotary device of the invention configured to operate as an internal combustion engine in which intake and compression phases occur on one rotor side and power and exhaust phases on the opposite rotor side.
Figure 27:
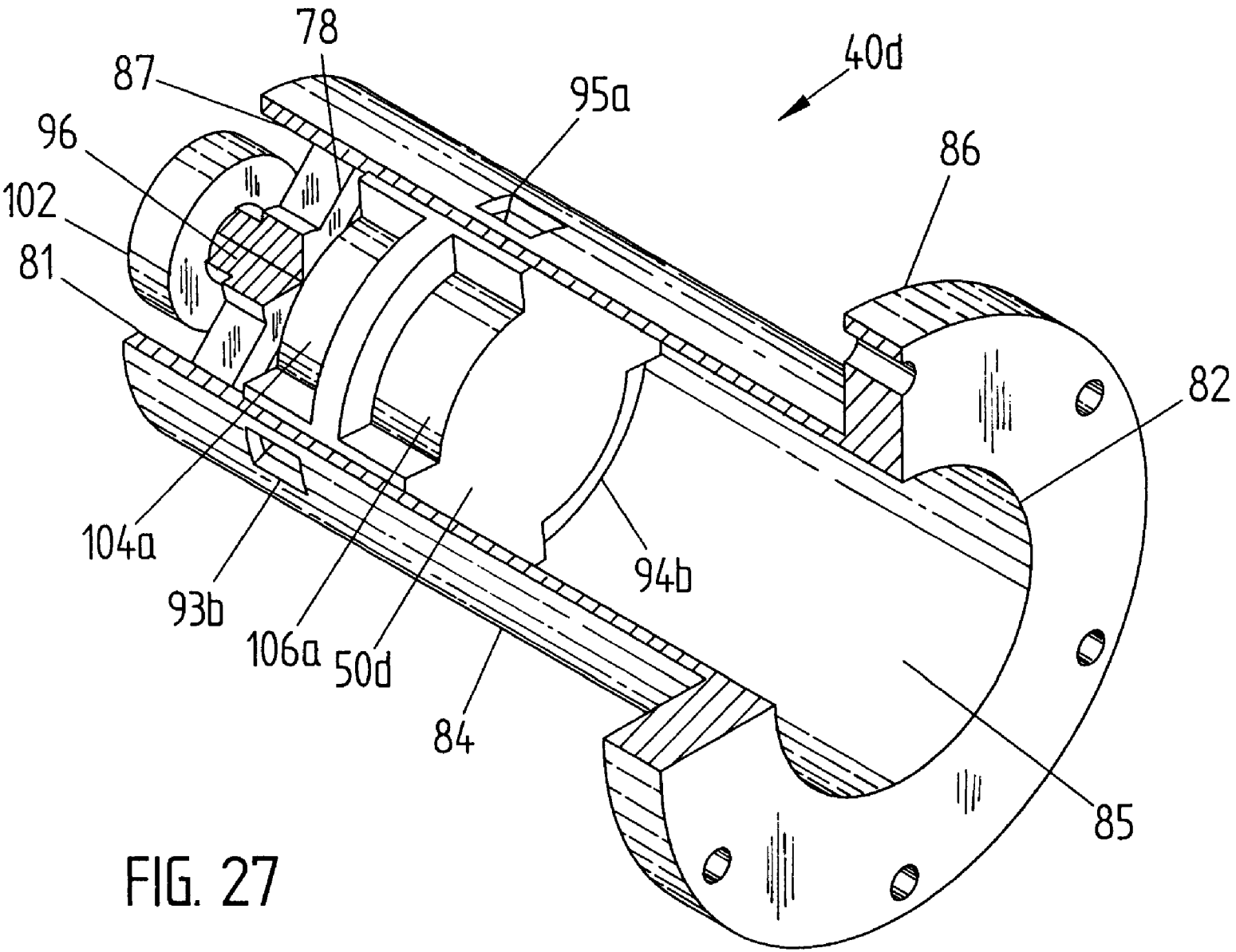
FIG. 27 is an isometric view of the inner stator portion of FIG. 26 having a portion cut away for the purpose of illustration.

The operation of the axial vane device 10 as one of a pump, compressor, expander and fluid-driven motor is illustrated with reference to FIG. 24, FIG. 25*a* and FIG. 25*b*. Operation as a pump or compressor is carried out by coupling the rotor shaft 44 to a source of rotation such as a motor to cause rotation of the rotor and the axial reciprocation of the vanes with respect to the rotor. This provides a two process sequence comprising a respective intake phase followed by a respective discharge phase occurring at each side end, where the sequence is arranged so that an intake phase at one end commences at the termination of a discharge phase occurring at the axially opposite end. When operating as an expander or fluid driven motor, a fluid source of high pressure is connected to an intake opening 34, so that the impelling net pressure forces on vanes causes rotation of the rotor and discharge of energy expended fluid. The undulating cam surface 26*a*, as shown in FIG. 17, proximal to the shaft end, together with the outer annular wall 23, the inner annular wall 31*a* and the rotor side wall 41*a* defines two volumetric regions, such that a sub-volume region bounded by two adjacent vanes enclosing a transfer passage 52*a* goes through volumetric variation comprising a first increasing volume region followed by a second decreasing volume region as the rotor completes one revolution. Similarly, the undulating cam surface 26*b* proximal to the end plate opposite to the shaft end defines, together with the outer annular wall 23, the inner annular wall 31*b* and rotor side wall 41*b*, two volumetric regions, arranged so that the sub-volume region bounded by two adjacent vanes enclosing a transfer passage 52*b* goes through volumetric variation comprising a first increasing volume region followed by a second decreasing volume region as the rotor completes one revolution. The variations of the two undulating cam surfaces are such that each rectangular vane has its side tips making a sliding contact or having a small clearance on these surfaces. Considering the process sequence taking place proximal to the shaft end as an example, it comprises an intake phase with an increasing volume region having a transfer port 58*a* in communication with the port 92*a*, followed by a decreasing volume region discharge phase with a transfer port 58*a* in communication with the discharge port 94*a*. A similar process takes place at the end wall further away from the shaft end but with a one hundred eighty degree phase shift.

Still another embodiment of the axial vane rotary device is one arranged to operate as a four-phase internal combustion engine with intake and compression phases taking place on one side of the rotor and power and exhaust phases taking place on the opposite side of the rotor as illustrated in FIG. 26 through FIG. 29*b*. In this embodiment of the device, each cam surface comprises two high portions proximal to respective rotor end walls alternated by two low portions distant from the same rotor end wall. In addition, the internal stator assembly 40 is replaced by the internal stator assembly 40*d* shown in FIG. 26. The internal stator assembly 40*d* comprises a stator tube 50*d* and a stator partitioning member 70*d*. The stator tube 50*d* comprises the tubular portion 84 comprising two sets of ports axially spaced apart. A first set of ports, which are relatively proximal to the intake end opening 81, comprise two diagonally opposite intake ports 92*a* and 92*b* alternated by two diagonally opposite intermediate discharge ports 93*a* and 93*b*. A second set of ports, relatively proximal to the exhaust end opening 82, comprises two diagonally opposite exhaust ports 94*a* and 94*b* alternated by two diagonally opposite intermediate intake ports 95*a* and 95*b*. The stator partitioning member 70*d* is disposed within the tubular portion of the stator tube 50*d* by fixture means (not shown). The internal stator partitioning member 70*d* partitions the cylindrical internal volume into two channels: a common exhaust channel 85 with exhaust opening 82; and a common intake channel 87 with end intake opening 81 in communication with plate 14 intake openings 34 proximal to the rotor shaft end. The partitioning member 70*d* comprises two diagonally opposite peripheral intake cutouts 104*a* and 104*b* aligned with respective ports 92*a*, 92*b* forming annular channels in communication with the common intake channel 87. Also, the partitioning member 70*d* comprises two diagonally opposed peripheral exhaust cutouts 106*a* and 106*b* aligned with respective exhaust ports 94*a* and 94*b* to form annular channels in communication with the common exhaust channel 85. Also, the second stator portion comprises two diagonally opposed intermediate discharge ports 105*a* and 105*b* aligned with respective intermediate discharge ports 93*a* and 93*b* of the first stator portion, and two diagonally opposite intermediate intake ports 107*a* and 107*b* aligned with respective intermediate intake ports 95*a* and 95*b*. Both the intermediate discharge and the intermediate intake ports are in communication with an intermediate transfer cavity 114 forming a transfer passageway between volumetric regions in both sides of the rotor.

The operation of the axial vane device 10 as a four-phase internal combustion engine is illustrated with reference to FIG. 28, FIG. 29*a* and FIG. 29*b*. Proximal to the shaft end, the undulating cam surface 26*a* defines, together with the outer annular wall 23, the inner annular wall 31*a* and the rotor side wall 41*a*, four volumetric regions arranged so that a sub-volume region bounded by two adjacent vanes enclosing a transfer passage 52*a* goes through volumetric variation comprising two increasing volume regions alternated by two decreasing volume regions as the rotor completes one revolution. The process sequence occurring at the rotor side proximal to the shaft end for a sub-volume enclosed between two adjacent vanes comprises four phases: a first intake phase in which a first increasing volume region has a transfer port 58*a* communicating with an intake port 92*a*; a first compression phase in which a first decreasing volume region has a transfer port 58*a* mostly blocked by the outer annular wall of the inner tubular stator portion 84 and terminating by transferring the compressed charge at minimum volume as the transfer port 58*a* registers with the first intermediate discharge port 93*a* in communication with the intermediate transfer cavity 114; a second intake phase in which the second increasing volume region has a transfer port 58*a* communicating with an intake port 92*b*; and a second compression phase in which a first decreasing volume region has a transfer port 58*a* mostly blocked by the outer annular wall of the inner tubular stator portion 84 and terminating by transferring the compressed charge at minimum volume as the transfer port 58*a* registers with the second intermediate discharge port 93*b* in communication with the intermediate transfer cavity 114. The process sequence occurring at the rotor side opposite end comprises four similar phases: a first power phase in which a first increasing volume region, having a transfer port 58*b* registering with the first intermediate intake port 95*a* at minimum volume, receives a compressed charge of air or fuel-air mixture from the intermediate transfer cavity 114 for ignition by an ignition means (not shown) disposed within a port 28*b* to initiate the first power phase expansion in which the transfer port 58*b* is mostly blocked by the outer annular wall 84 of the inner stator portion; a first exhaust phase in which the first decreasing volume region has a transfer port 58*b* in communication with exhaust port 94*a*; a second power phase in which a second increasing volume region, having a transfer port 58*b* registering with intermediate intake port 95*b* at minimum volume, receives a compressed charge of air or fuel-air mixture from the intermediate transfer cavity 114 for ignition by an ignition means (not shown) disposed within a port 28*b*, thus initiating the second power phase in which the transfer port 58*b* is mostly blocked by the outer annular wall 84 of the inner stator portion; and a second exhaust phase in which the second decreasing volume region having a transfer port 58*b* in communication with the exhaust port 94*b*.

Still another embodiment of the axial vane rotary device 10 is one configured to operate as a four-phase internal combustion engine in which intake and compression phases take place on one side of the rotor and power and exhaust phases take place on the opposite side of the rotor as shown in FIG. 30 through 32*b*. In this embodiment of the device, each cam surface, as shown in FIG. 17, comprises one high portion proximal to a respective rotor end and a low portion distal from the same rotor end wall. Moreover, the internal stator assembly is replaced by the internal stator assembly 40*e* shown in FIG. 30. This internal stator assembly 40*e* comprises a stator tube 50*e* and a stator partitioning member 70*e*. The stator tube 50*e* comprises a tubular portion 84 comprising two sets of ports axially spaced apart. A first set of ports relatively proximal to intake end opening 81 comprises one intake port 92 and one intermediate discharge port 93. A second set of ports relatively proximal to the exhaust end opening 82 comprises one exhaust port 94 and one intermediate intake port 95. The partitioning member 70*e* is retained within the tubular portion of the stator tube 50*e* by fixture means (not shown). The partitioning member 70*e* partitions the cylindrical internal volume into two channels, a common exhaust channel 85 with an exhaust opening 82, and a common intake channel 87 with an end intake opening 81 in communication with end plate 14 intake openings 34 proximal to the rotor shaft end. The partitioning member 70*e* comprises one peripheral intake cutout 104 aligned with a respective port 92 and forming an annular channel in communication with the common intake channel 87. Also, the partitioning member 70*e* comprises one peripheral exhaust cutout 106 aligned with a respective exhaust port 94 forming an annular channel in communication with the common exhaust channel 85. Also, the partitioning member 70*e* comprises one intermediate discharge port 105 aligned with a respective intermediate discharge port 93 of the first stator portion, and one intermediate intake port 107 aligned with a respective intermediate intake port 95. In this arrangement, both the intermediate discharge and intermediate intake ports are in communication with an intermediate transfer cavity 114 forming a transfer passageway between volumetric regions at both sides of the rotor.

The operation of the axial vane device as a four-phase internal combustion engine is illustrated with reference to FIG. 32, FIG. 33*a* and FIG. 33*b*. Proximal to the shaft end, the undulating cam surface 26*a* defines, together with the outer annular wall 23, the inner annular wall 31*a* and the rotor side wall 41*a*, two volumetric regions arranged so that the sub-volume region bounded by two adjacent vanes enclosing a transfer passage 52*a* goes through volumetric variation comprising one increasing volume region and one decreasing volume region as the rotor completes one revolution. The process sequence occurring at the rotor side proximal to the shaft end for a sub-volume enclosed between two adjacent vanes comprises two phases: an intake phase in which an increasing volume region has a transfer port 58*a* communicating with an intake port 92; followed by a compression phase in which a decreasing volume region has a transfer port 58*a* that is mostly blocked by the outer annular wall of the inner tubular stator portion 84. The compression phase terminates by transferring the compressed charge at minimum volume as the transfer port 58*a* register with the intermediate discharge port 93 in communication with the intermediate transfer cavity 114. The process sequence occurring at the rotor side opposite end comprises two phases: a power phase in which the increasing volume region having a transfer port 58*b* initially registering with the intermediate intake port 95 at minimum volume receives a compressed charge of air or fuel-air mixture from the intermediate transfer cavity 114 for ignition by an ignition means (not shown) disposed within a port 28*b*, thus initiating the power phase expansion in which the transfer port 58*b* is mostly blocked by the outer annular wall 84 of the inner stator portion; followed by an exhaust phase in which the decreasing volume region has a transfer port 58*b* in communication with the exhaust port 94

It will be understood by someone skilled in the art that many of the details provided above are by way of example only and are not intended to limit the scope of the invention which is to be determined with reference to the following claims.

I claim:

1. Apparatus for moving a vane axially in an axial vane rotary device, the apparatus comprising:

a stator comprising outer and inner portions jointly defining an annular internal chamber having two end plates comprising mutually facing respective annular cam surfaces;

a rotor comprising an axial slot for slidingly receiving the vane therein;

a guide cam groove formed in an outer wall of the chamber;

a substantially hemispherical recess disposed in an outer edge of the vane; and a freely movable ball element cam follower engaging both the recess and the guide cam groove, the ball element having a radius greater than a depth of the cam groove and a depth of the recess.

2. An axial vane rotary device comprising:

a stator comprising an outer portion and an inner portion together defining a substantially annular internal chamber extending axially between two end plates comprising mutually facing respective cam surfaces;

the inner stator portion comprising a central cylindrical portion comprising two sets of peripheral ports, each set disposed at a respective axial position, at least one peripheral port in each set thereof connected to at least one of an intake passageway and an exhaust passageway; and a rotor assembly rotatably mounted within the annular chamber,the rotor assembly comprising a shaft extending from a rotor block along an axis of the device, the rotor block having two axially spaced apart sides, the rotor block comprising:

a central bore receiving therewithin the inner stator portion;

axially spaced pairs of transfer passages, each passage of a pair thereof providing fluid communication between a respective side of the rotor block and a respective transfer port opening to the central bore in axial alignment with one of the sets of peripheral ports;

a plurality of slots, each extending from one side of the rotor block to the other, the slots angularly disposed alternatively with the pairs of transfer passages; and vanes slidably disposed within respective slots for axial reciprocation therewithin, each vane comprising an outer edge engaging the outer annular wall and two side edges each engaging a respective one of the cam surfaces.

3. The axial vane rotary device of claim 2 wherein each cam surface comprises at least one high portion relatively proximal to the rotor block and at least one low portion relatively distal therefrom, each high portion of one cam surface aligned with a respective low portion of the opposite cam surface.

4. The axial vane rotary device of claim 2 wherein each cam surface comprises at least one high portion relatively proximal to the rotor block and at least one low portion relatively distal therefrom, the device further comprising at least one ignition port disposed within the at least one high portion of one of the cam surfaces.

5. The axial vane rotary device of claim 2 wherein the rotor further comprises a plurality of radially extending blades having respective inner ends fixed to the shaft respective and outer ends fixed to the block, so as to provide fluid communication between the central bore and an outside of the external stator.

6. The axial vane rotary device of claim 2, further comprising a turbocharger assembly rotatably mounted within the inner stator portion, the internal turbocharger assembly comprising a turbine portion drivingly coupled to a compressor portion.

7. The axial vane rotary device of claim 2, wherein each cam surface comprises:

two high portions relatively proximal the block alternated by two low portions relatively distal from the block; and at least one ignition port disposed within one of the high portions of one of the cam surfaces; and wherein each set of peripheral ports comprises exactly one intake port and exactly one exhaust port, whereby the device is operable as a four-phase internal combustion engine.

8. The axial vane rotary device of claim 2, wherein each cam surface comprises:

exactly one high portion relatively proximal the block and one low portion distal therefrom; and at least one ignition port disposed within the one high portion of one of the cam surfaces, and wherein each set of peripheral ports comprises exactly one intake port and exactly one exhaust port, whereby the device is operable as a two-phase internal combustion engine.

9. The axial vane rotary device of claim 1, wherein:

each cam surface comprises two high portions relatively proximal the block alternated by two low portions relatively distal therefrom; and each set of peripheral ports comprises two diametrically opposite intake ports alternated by two diametrically opposite exhaust ports;

whereby the device is operable as one of a pump, a compressor, a fluid driven motor, and an expander.

10. The axial vane rotary device of claim 2, wherein:

each cam surface comprises exactly one high portion relatively proximal the block and one low portion relatively distal therefrom; and each set of peripheral ports comprises exactly one intake port angularly adjacent to exactly one exhaust port;

whereby the device is operable as one of a pump, a compressor, a fluid driven motor and an expander.

11. The axial vane rotary device of claim 2, wherein:

each cam surface comprises:

two high portions relatively proximal the block alternated by two low portions relatively distal therefrom, and at least one ignition port disposed within one of the high portions of one of the cam surfaces;

a first of the two sets of peripheral ports comprises two diametrically opposite intake ports alternated by two intermediate discharge ports in communication with an intermediate transfer cavity; and the second set of peripheral ports comprises two diametrically opposite exhaust ports alternated by two intermediate intake ports in communication with the intermediate transfer cavity; and the intermediate transfer cavity connects the intermediate discharge ports to the intermediate intake ports;

whereby the device is operable as an internal combustion engine.

12. The axial vane rotary device of claim 2, wherein: each cam surface comprises:

a high portion relatively proximal the block and a low portion relatively distal therefrom, and at least one ignition port disposed within the high portion of one of the cam surfaces, a first of the two sets of peripheral ports comprises one intake port and one intermediate discharge port in communication with an intermediate transfer cavity;

the second set of peripheral ports comprises one exhaust port and one intermediate intake port in communication with the intermediate transfer cavity; and the intermediate transfer cavity connects the intermediate discharge port to the intermediate intake port;

whereby the device is operable as an internal combustion engine.

13. An axial vane internal combustion engine comprising:

a stator comprising an outer portion and an inner portion together defining a predominantly annular internal chamber having two end plates comprising mutually facing respective cam surfaces, the inner stator portion comprising a central cylindrical portion comprising at least two sets of axially spaced apart peripheral ports, at least one port in each set thereof connected to at least one of an intake passageway and an exhaust passageway; and a rotor assembly rotatably mounted within the annular chamber, the rotor assembly comprising a shaft extending from a rotor block along an axis of the device, the shaft protruding through one of the end plates; the rotor block comprising:

a central bore receiving therewithin the inner stator portion;

axially spaced apart pairs of transfer passages, each passage of a pair thereof providing fluid communication between a respective side of the rotor block and a respective transfer port opening to the central bore in axial alignment with one of the sets of peripheral ports;

a plurality of slots, each extending from one side of the rotor block to the other, the slots angularly disposed alternatively with the pairs of transfer passages; and vanes slidably disposed within respective slots for axial reciprocation therewithin, each vane comprising an outer edge engaging the outer annular wall and two side edges, each engaging a respective one of the cam surfaces.

14. The axial vane rotary device of claim 13 wherein each cam surface comprises at least one high portion relatively proximal to the rotor block and at least one low portion relatively distal therefrom, the device further comprising at least one ignition port disposed within the at least one high portion of one of the cam surfaces.

15. The axial vane rotary internal combustion engine of claim 13, wherein:

each cam surface comprises two high portions relatively proximal to the rotor block alternated by two low portions relatively distal therefrom;

the engine further comprises at least one ignition port disposed within one of the high portions of one of the cam surfaces; and each of the two axially spaced apart sets of peripheral ports comprises one respective intake port angularly adjacent to one respective exhaust port;

whereby the device is operable as a four-phase internal combustion engine.

16. The axial vane rotary internal combustion engine of claim 13, wherein:

each of the cam surfaces comprises one high portion relatively proximal to the rotor block and one low portion relatively distal therefrom;

the engine further comprises at least one ignition port disposed within one of the high portions of one of the surfaces; and each of the two sets of peripheral ports comprises one respective intake port axially adjacent to one respective exhaust port;

whereby the device is operable as a two-phase internal combustion engine.

17. The axial vane rotary internal combustion engine of claim 13, wherein:

each cam surface comprises two high portions relatively proximal to the rotor block alternated by two low portions relatively distal therefrom;

the engine further comprises at least one ignition port disposed within one the high portions of one of the cam surfaces;

one of the two sets of peripheral ports comprises two diametrically opposite intake ports alternated by two intermediate discharge ports;

the second of the two sets of peripheral ports comprises two diametrically opposite exhaust ports alternated by two intermediate intake ports; and the inner stator portion comprises an intermediate transfer cavity comprising a transfer passageway connecting the intermediate discharge ports to the intermediate intake ports;

whereby the engine is operable with intake and compression phases occurring adjacent one of the two sides of the rotor and wherein the compressed charge is transferred via the intermediate transfer cavity to the opposite side of the rotor for power and exhaust phases to take place.

18. The axial vane rotary internal combustion engine of claim 13, wherein:

each cam surface comprises one high portion relatively proximal to the rotor block and one low portion relatively distal therefrom;

the engine further comprises at least one ignition port disposed within the high portion of one of the cam surfaces;

one of the two sets of peripheral ports comprises one intake port and one intermediate discharge port;

the second of the two sets of peripheral ports comprises one exhaust port and one intermediate intake port; and the inner stator portion comprises an intermediate transfer cavity comprising a passageway connecting the intermediate discharge port to the intermediate intake port;

whereby the engine is operable with intake and compression phases occurring adjacent one side of the rotor and power and exhaust phases occurring adjacent the opposite side of the rotor.

19. The axial vane rotary engine of claim 13 wherein the rotor assembly further comprises a supercharger comprising an axial fan portion comprising a plurality of blades having inner ends fixed to the shaft and outer ends fixed to the rotor block.

20. The axial vane rotary engine of claim 13, further comprising a turbocharger assembly rotatably mounted within the inner stator portion and comprising a turbine drivingly coupled to a compressor.

21. An axial vane rotary device operable as one of a pump, a compressor, an expander and a fluid-driven motor, the device comprising:

a stator comprising outer and inner portions jointly defining an annular internal chamber having two end plates comprising mutually facing respective annular cam surface;

the inner stator portion comprising a central cylindrical portion comprising at least two sets of axially spaced apart peripheral ports, at least one peripheral port in each set thereof connected to at least one of an intake passageway and an exhaust passageway; and a rotor assembly rotatably mounted within the annular chamber and comprising a rotor block and a shaft extending axially therefrom, the shaft protruding through one of the end plates;

the rotor block comprising:

a central bore receiving the inner stator portion;

axially spaced apart pairs of transfer passages, each passage of a pair thereof providing fluid communication between a respective side of the rotor block and a respective transfer port opening to the central bore in axial alignment with one of the sets of peripheral ports;

a plurality of slots, each extending from one side of the rotor block to the other, the slots angularly disposed alternatively with the pairs of transfer passages; and vanes slidably disposed within respective slots for axial reciprocation therewithin, each vane comprising an outer edge engaging the outer annular wall and two side edges, each engaging a respective one of the cam surfaces.

22. The axial vane device of claim 21, wherein:

each cam surface comprises two high portions relatively proximal to the rotor block alternated by two low portions relatively distal therefrom; and each set of peripheral ports comprises two diametrically opposite intake ports alternated by two diametrically opposite exhaust ports.

23. The axial vane device of claim 21 wherein:

each cam surface comprises one high portion relatively proximal the rotor block and one low portion relatively distal therefrom; and each of the two sets of peripheral ports comprises one respective intake port and one respective exhaust port.

* * * * *

UNITED STATES PATENT AND TRADEMARK OFFICE

CERTIFICATE OF CORRECTION

PATENT NO. : 7,140,853 B2
APPLICATION NO. : 10/935680
DATED : November 28, 2006
INVENTOR(S) : Osama M Al Hawaj It is certified that error appears in the above-identified patent and that said Letters Patent is hereby corrected as shown below:

Col. 16, Claim 9, line 1 after "claim" replace "1" with -- 2 -- .

Signed and Sealed this

Sixth Day of February, 2007

JON W. DUDAS
*Director of the United States Patent and Trademark Office*